US006088300A

United States Patent [19]

Nakajima et al.

[11] Patent Number: 6,088,300

[45] Date of Patent: Jul. 11, 2000

[54] CALENDAR ELECTRONIC TIMEPIECE

[75] Inventors: Kenichi Nakajima; Takayuki Satodate; Akihiro Matouge; Akihiko Inada; Mitsuru Ishii; Yoshio Koyama; Shigeo Suzuki; Masayuki Kawata; Yuko Sasaki; Eriko Takakuwa, all of Chiba, Japan

[73] Assignee: Seiko Instruments Inc., Japan

[21] Appl. No.: 09/065,992

[22] Filed: Apr. 24, 1998

[30] Foreign Application Priority Data

Apr. 25, 1997 [JP] Japan ..... 9-109445

[51] Int. Cl.[7] ..... G04B 19/24; G04B 19/20

[52] U.S. Cl. ..... 368/28; 368/37

[58] Field of Search ..... 368/28, 34–37, 368/157

[56] References Cited

U.S. PATENT DOCUMENTS 4,060,976 12/1977 Jakob .

4,198,808 4/1980 Tamaru ..... 368/37

4,271,494 6/1981 Miyazaki ..... 368/34

5,274,614 12/1993 Yamazaki ..... 368/28

*Primary Examiner*—Vit Miska

*Attorney, Agent, or Firm*—Adams & Wilks

[57] ABSTRACT

A calendar electronic timepiece comprises a signal generating circuit for generating a date signal, a driving circuit for outputting a driving signal in accordance with the date signal generated by the signal generating circuit, and an ultrasonic motor driven by the driving signal outputted by the driving circuit. The ultrasonic motor is comprised of a piezoelectric vibrator having an electrode pattern and being driven by the driving signal outputted from the driving circuit to undergo expansion and contraction movement, a vibrating member connected to the piezoelectric vibrator and vibrationally driven by expansion and contraction movement of the piezoelectric vibrator, and a date dial disposed on the vibrating member to be frictionally driven by expansion and contraction movement of the piezoelectric vibrator.

5 Claims, 31 Drawing Sheets

CALENDAR ELECTRONIC TIMEPIECE

BACKGROUND OF THE INVENTION

The present invention relates to calendar electronic timepieces that are capable of indicating a date, and more particularly to a calendar electronic timepiece that can rotate a date dial with high torque by using an ultrasonic motor and accurately position a date character of the date dial in position.

In a conventional calendar electronic timepiece having a single motor, a battery 902 constitutes a power source, for example, as shown in FIG. 21. An IC 904 is connected to the battery 902 to count time information about a time and date, etc. A timepiece motor 906 rotates, for example, by 180 degrees per second based on a time information signal outputted by the IC 904. A multistage reduction wheel train 908 is formed by a plurality of gears. The multistage reduction wheel train 908 reduces and transmits the speed of the timepiece motor 906 to rotate a hand driving wheel 910. Time information, e.g. "hour", "minute" and "second", is indicated by the hand driving wheel 910 formed respectively by an hour pointer, a minute pointer and a second pointer.

A date dial 912 is intermittently operated by the multistage reduction wheel train 908 to indicate a "date" by a character of from "1" to "31" provided on indicating surfaces of the date dial 912.

In a conventional calendar electronic timepiece having a plurality of motors, a battery 902 constitutes a power source, for example, as shown in FIG. 22. An IC 904 is connected to the battery 902 to count time information about a time and date, etc. A timepiece motor 906 rotates, for example, by 180 degrees per second based on a time information signal outputted by the IC 904. A reduction wheel train (not shown) is formed reduces and transmits the speed of the timepiece motor 906 to rotate a hand driving wheel 910. Time information, e.g. "hour", "minute" and "second", is indicated by the hand driving wheel 910 formed respectively by an hour pointer, a minute pointer and a second pointer.

A date dial motor 914 is rotated based on date information signal outputted by the IC 904. A multistage reduction wheel train 916 reduces and transmits the speed of a date dial motor to rotate a date dial 912. A "date" is indicated by a character of from "1" to "31" provided on indicating surfaces of the date dial 912.

In a conventional calendar electronic timepiece having a plurality of motors, a date dial motor 914 includes a coil block 918 for the date dial motor, a date dial stator 920, and a date dial stator 922, as shown in FIG. 23 and FIG. 24. A multi-stage reduction wheel train 916 includes a first transmitting wheel 924, a second transmitting wheel 926, and a date driving wheel 928. The date driving wheel 928 is in mesh with a tooth portion 912*a* of a date dial. Numerals of from "1" to "31" are provided on indicating surfaces 912*b* of the date dial.

An IC 904 counts time information about a time and date, etc. When outputting a result of the count of 0 o'clock a.m., the date dial motor 914 rotates based on the time information signal outputted by the IC 904. This turns, through the first transmitting wheel 924, the second transmitting wheel 926 and the date dial wheel 928, the date dial 912 by 360°/31, i.e. a 1/31 rotation.

Furthermore, in an analog-type electronic timepiece using an ultrasonic motor as a timepiece motor 906, time is indicated by an hour pointer, a minute pointer, and a second pointer through a wheel train driven by a moving body of the ultrasonic motor. For example, there is disclosed, e.g. in Japanese Laid-Open Patent Publication No. H2-287281, a structure of an analog-type electronic timepiece using a standing-wave type ultrasonic motor.

Further, in an electronic appliance using a conventional ultrasonic motor and an ultrasonic motor, there is provided a vibrating member joined with a piezoelectric element so that the moving body is frictionally driven by vibrating waves generated in the vibrating member due to expansion and contraction of the piezoelectric element. A pressure applying means causes the moving body to be pressure-contacted with the vibrating member. An oscillation driving circuit applies a drive signal to an electrode group formed in the piezoelectric element. This drive signal causes the piezoelectric element to expand, generating vibrating waves on the vibrating member. The vibrating waves cause the moving body to be frictionally driven. The structure of an electronic appliance using the conventional ultrasonic motor and the ultrasonic motor is disclosed, e.g. in Japanese Laid-Open Patent Publication No. H8-251952.

In a conventional calendar electronic timepiece having a date driving motor, a wheel train is provided, at a part thereof, with a 24-hour contact 932 for detecting a rotational position of the wheel train 930, as shown in FIG. 25. When the 24-hour contact 932 detects a position corresponding to 0 o'clock a.m., the 24-hour contact 932 outputs a detection signal by which a circuit block 934 causes the date driving motor 936 to rotate. The rotation of the date driving motor 936 rotates the date dial 912 through a reduction wheel train 938. This makes possible change of date indication.

Furthermore, in a calendar electronic timepiece having a CPUIC, a circuit block (CPUIC) 940 counts time, as shown in FIG. 26. When counting by 24 hours, the date driving motor 936 is rotated. The rotation of the date driving motor 936 causes the date dial 912 to rotate through rotation of the reduction wheel train 938. This makes possible change of date indication.

However, there have been problems in the conventional calendar electronic timepieces, as below.

(1) The conventional calendar electronic timepiece having a single motor cannot accurately rotate only the date dial at a high speed.

(2) The conventional calendar electronic timepiece having a plurality of motors requires a coil block for a date dial motor, a stator for the date dial motor, a rotor for the date dial motor and a multi-stage reduction wheel train having a multiplicity of gears, thereby increasing the size of the timepiece. This makes it substantially impossible to manufacture watches for women.

(3) The conventional calendar electronic timepiece having a plurality of motors also is slow in rotational speed of the date dial, that is, it takes long in moving the calendar.

(4) The conventional calendar electronic timepiece having a plurality of motors further is small in drive torque to the date dial. This in turns, makes it impossible to provide a date jumper for rectifying the position of the date dial.

(5) The conventional calendar electronic timepiece having a plurality of motors further requires a multiplicity of multi-stage reduction wheel trains. Accordingly, the date dial is difficult to accurately align the position due to backlash for each wheel train.

(6) In the conventional calendar electronic timepiece having a 24-hour contact for detecting a rotational position of the wheel train, there are a number of wheel trains arranged from the wheel train to the date dial. Accordingly, the date dial is difficult to accurately align the position due to backlash for each wheel train.

(7) The conventional calendar electronic timepiece having a CPUIC is difficult to indicate a correct date in an event that malfunction occurs in rotation of the date driving motor.

SUMMARY OF THE INVENTION

Therefore, in order to solve the conventionally-encountered problems, it is an object of the present invention to provide a calendar electronic timepiece which is capable of accurately indicating a date.

It is another object of the present invention to provide a calendar electronic timepiece having a short calendar moving time.

Further, it is another object of the present invention to provide a calendar electronic timepiece having a great drive torque to a date driving motor.

Further, it is another object of the present invention to provide a calendar electronic timepiece that is small and thin in size.

Further, it is another object of the present invention to provide a calendar electronic timepiece that can accurately align the date dial in position by using a date.

In order to solve the above problem, the present invention is structured by, in a calendar electronic timepiece, having a function to indicate information about calendar, the calendar electronic timepiece being characterized by comprising: a control circuit having a calendar signal generating circuit for counting on information about calendar such as year, month and day to generate a calendar signal, and an ultrasonic motor driving circuit for outputting an ultrasonic motor driving signal to rotate an ultrasonic motor based on the calendar signal outputted by the calendar signal generating circuit; an ultrasonic motor having an ultrasonic stator joined with a piezoelectric element, and an ultrasonic rotor inputted by the ultrasonic motor driving signal to be frictionally driven by vibrating waves generated on the ultrasonic stator due to expansion and contraction of the piezoelectric element; a calendar indicating wheel operated based on rotation of the ultrasonic rotor to indicate information about calendar.

With this structure, it is possible to realize a small-sized calendar electronic timepiece that can accurately indicate information about a calendar such as "year", "month", "day", "day of the week" and "six days of the week".

A calendar electronic timepiece of the present invention is preferably structured such that the calendar indicating wheel is a date dial for indicating information about days, the calendar signal generating circuit counting on information about a leap year and a day of from January to December, the ultrasonic motor driving circuit outputting a different ultrasonic motor drive signal from that for changing from an end of a large month to a succeeding month based on a count result of the calendar signal generating circuit when changing from an end of a small month to a succeeding month so that a day indication of 1 is made on a 1st day of each month.

With this structure, it is possible to realize so-called an "auto-calendar timepiece" that accurately indicates a date.

Also, a calendar electronic timepiece of the present invention is preferably structured such that a calendar wheel train is provided to operate based on the rotation of the ultrasonic rotor, the calendar indicating wheel being operated by the calendar wheel train.

Further, a calendar electronic timepiece of the present invention is preferably structured such that a finger is provided to operate based on the rotation of the ultrasonic rotor, the calendar indicating wheel being rotated by the finger.

With this structure, it is possible to accurately actuate a calendar indicating wheel and realize a small-sized calendar electronic timepiece.

Further, a calendar electronic timepiece of the present invention, in particular, is preferably structured such that a rectifying member is provided to rectifying a position along a rotational direction of the calendar indicating wheel.

With this structure, it is possible to accurately position the calendar indicating wheel in position.

Further, the present invention is structured by, in a calendar electronic timepiece, having a function to indicate information about calendar, the calendar electronic timepiece being characterized by comprising: a time signal generating circuit for counting on information about date to generate a date signal; an ultrasonic motor driving circuit for outputting an ultrasonic motor driving signal to drive an ultrasonic motor based on the date signal outputted by the time signal generating circuit; an ultrasonic motor having an ultrasonic stator joined with a piezoelectric element, and an ultrasonic rotor inputted by the ultrasonic motor driving signal to be frictionally driven by vibrating waves generated on the ultrasonic stator due to expansion and contraction of the piezoelectric element; a calendar wheel train rotated by rotation of the ultrasonic rotor; a date finger rotated by rotation of the calendar wheel train; a date dial rotated by rotation of the date finger to indicate a date.

With this structure, the date dial is stabilized in rotational characteristics because high torque can be produced and the calendar wheel train is driven by the ultrasonic motor.

Also, the present invention is structured by, in a calendar electronic timepiece, having a function to indicate information about calendar, the calendar electronic timepiece being characterized by comprising: a time signal generating circuit for counting on information about date to generate a date signal; an ultrasonic motor driving circuit for outputting an ultrasonic motor driving signal to drive an ultrasonic motor based on the date signal outputted by the time signal generating circuit; an ultrasonic motor having an ultrasonic stator joined with a piezoelectric element, and an ultrasonic rotor inputted by the ultrasonic motor driving signal to be frictionally driven by vibrating waves generated on the ultrasonic stator due to expansion and contraction of the piezoelectric element; a calendar wheel train rotated by rotation of the ultrasonic rotor and having a date finger; a date dial rotated by rotation of the date finger to indicate a date.

Also, the present invention is structured by, in a calendar electronic timepiece, having a function to indicate information about calendar, the calendar electronic timepiece being characterized by comprising: a time signal generating circuit for counting on information about date to generate a date signal; an ultrasonic motor driving circuit for outputting an ultrasonic motor driving signal to drive an ultrasonic motor based on the date signal outputted by the time signal generating circuit; an ultrasonic motor having an ultrasonic stator joined with a piezoelectric element, and an ultrasonic rotor inputted by the ultrasonic motor driving signal to be frictionally driven by vibrating waves generated on the ultrasonic stator due to expansion and contraction of the piezoelectric element and having a date finger; a date dial rotated by rotation of the date finger provided on the ultrasonic rotor to indicate a date.

Further, the present invention is structured by, in a calendar electronic timepiece, having a function to indicate information about calendar, the calendar electronic timepiece being characterized by comprising: a time signal generating circuit for counting on information about date to generate a date signal; an ultrasonic motor driving circuit for outputting an ultrasonic motor driving signal to drive an ultrasonic motor based on the date signal outputted by the time signal generating circuit; an ultrasonic motor having an ultrasonic stator joined with a piezoelectric element, and an ultrasonic rotor constituting a date dial inputted by the ultrasonic motor driving signal to be frictionally driven by vibrating waves generated on the ultrasonic stator due to expansion and contraction of the piezoelectric element.

With this structure, it is possible to reduce the number of the calendar wheel trains to thereby realize a small-sized calendar electronic timepiece.

Also, a calendar electronic timepiece of the present invention is preferably structured such that a date jumper is provided in engagement with a tooth portion of the date dial to rectify a rotational position of the date dial.

With this structure, it is possible to accurately maintain the position of the date dial to thereby reduce the fear of positional deviation of a date character.

DETAILED DESCRIPTION OF THE PREFERRED EMBODIMENTS

Embodiments of the present invention will be explained hereinbelow based on the drawings.

(1) First Embodiment

Figure 1:
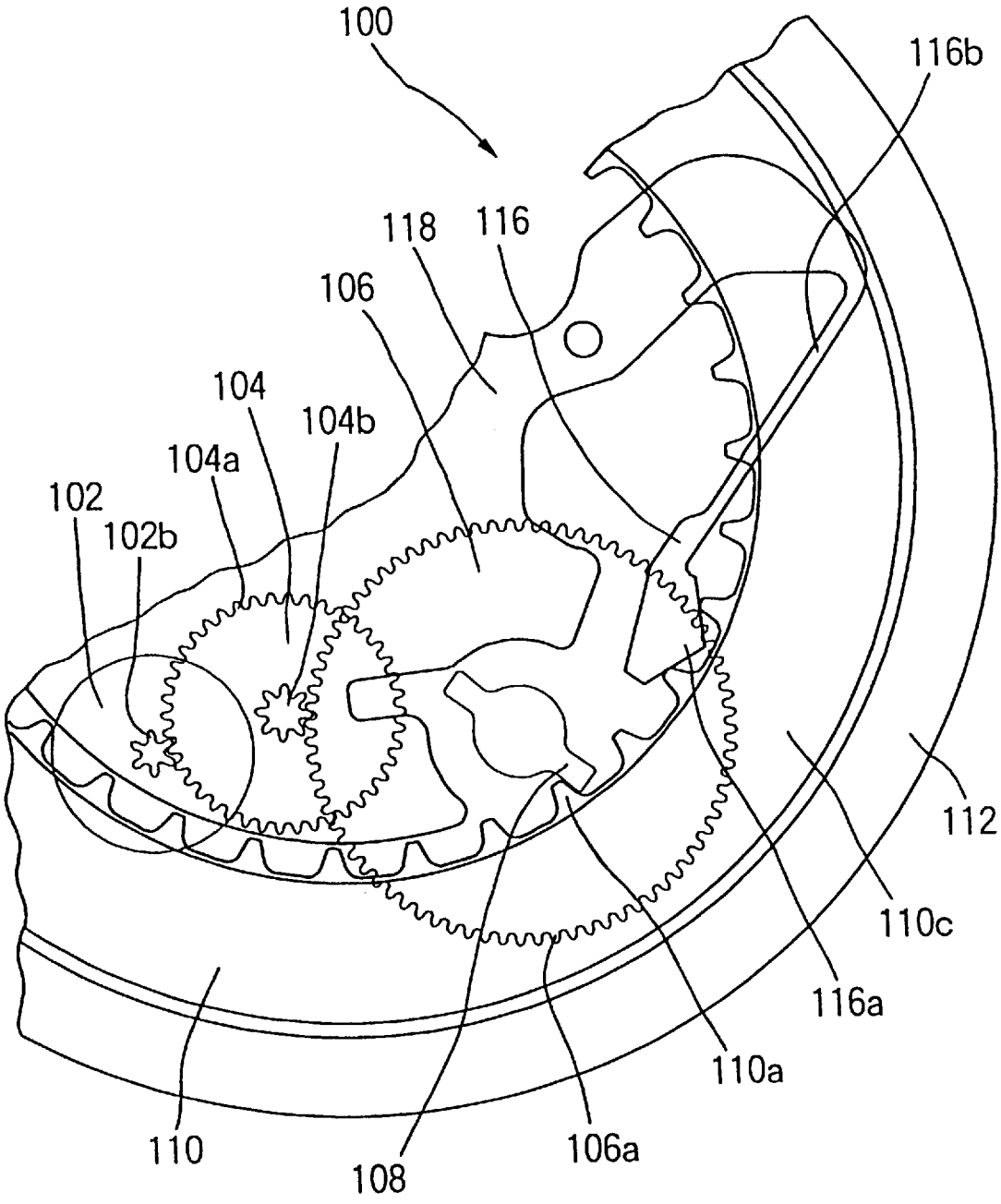
[FIG. 1] A schematic plan view (projection view) showing a calendar mechanism portion of a first embodiment of a calendar electronic timepiece of the present invention.
Figure 2:
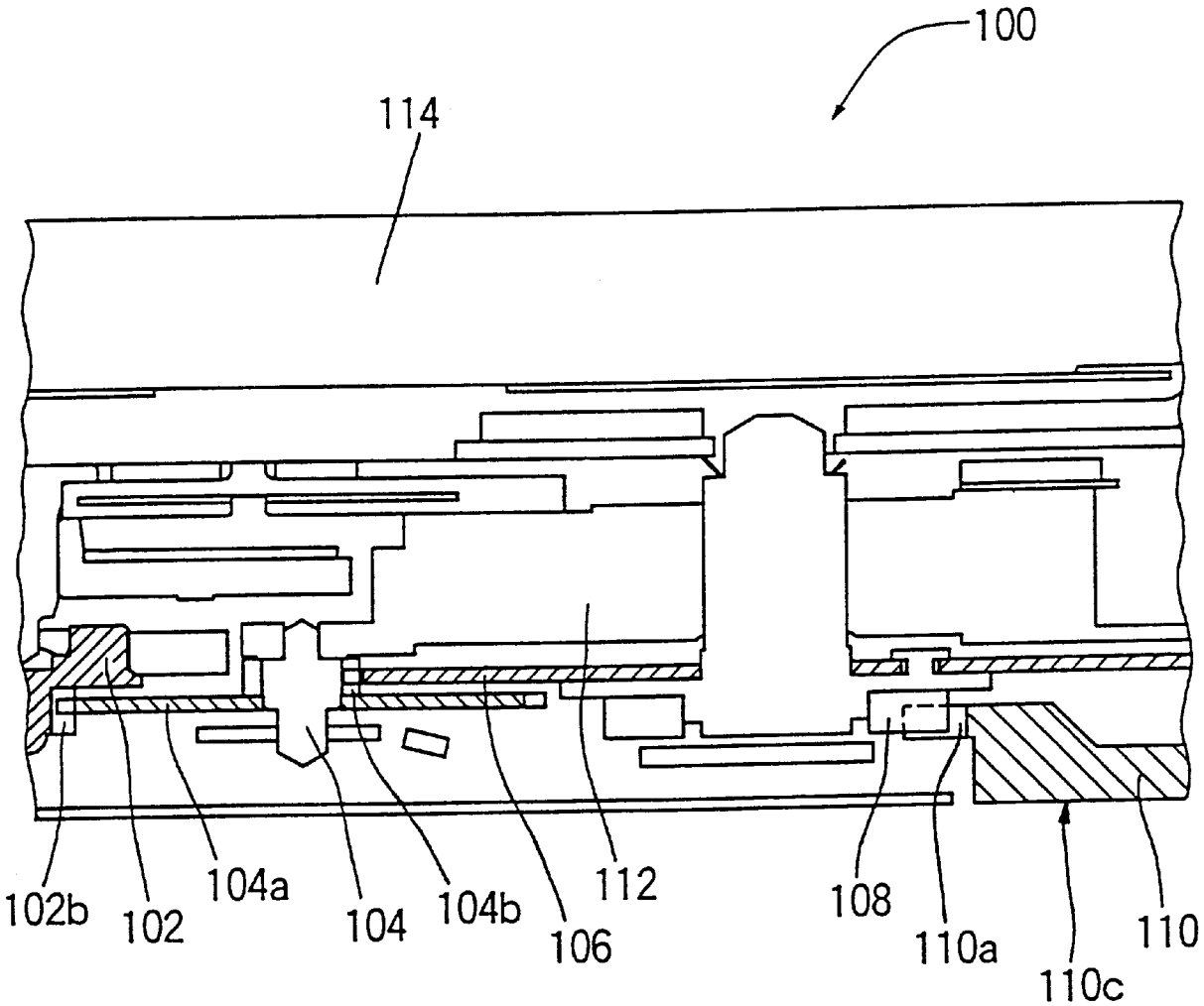
[FIG. 2] A schematic sectional view showing the calendar mechanism portion of the first embodiment of the calendar electronic timepiece of the present invention.

In FIG. 1 and FIG. 2, an ultrasonic motor as a first embodiment of a calendar electronic timepiece 100 of the present invention includes an ultrasonic rotor 102. The ultrasonic rotor 102 has an ultrasonic rotor kana 102*b* in mesh with an intermediate date driving gear 104*a* of an intermediate date driving wheel 104. The intermediate date driving wheel 104 has an intermediate date driving kana 104*b* in mesh with a date driving gear 106*a* of a date driving wheel 106.

A date finger 18 is provided on the date driving wheel 106 so as to be simultaneously rotated by the rotation of the date driving wheel 106. As shown in FIG. 1, the date finger 108 may be provided with two finger portions or the date finger 108 may be provided with one or three or more finger portions.

A date dial 110 having 31 date wheel teeth 110*a* is rotatably assembled on a main plate 112. The date dial 110 has numerals "1" to "31" (not shown) on indicating surfaces 110*c*. A battery 114 is attached onto an opposite side of the main plate 112 to the side having the date dial 110.

A date jumper 116 is integrally formed with a date dial holder 118. The date jumper 116 has a rectifying portion 116*a* for rectifying the date dial teeth 110*a*. The date jumper 116 has a date jumper spring portion 116*b*.

Figure 3:
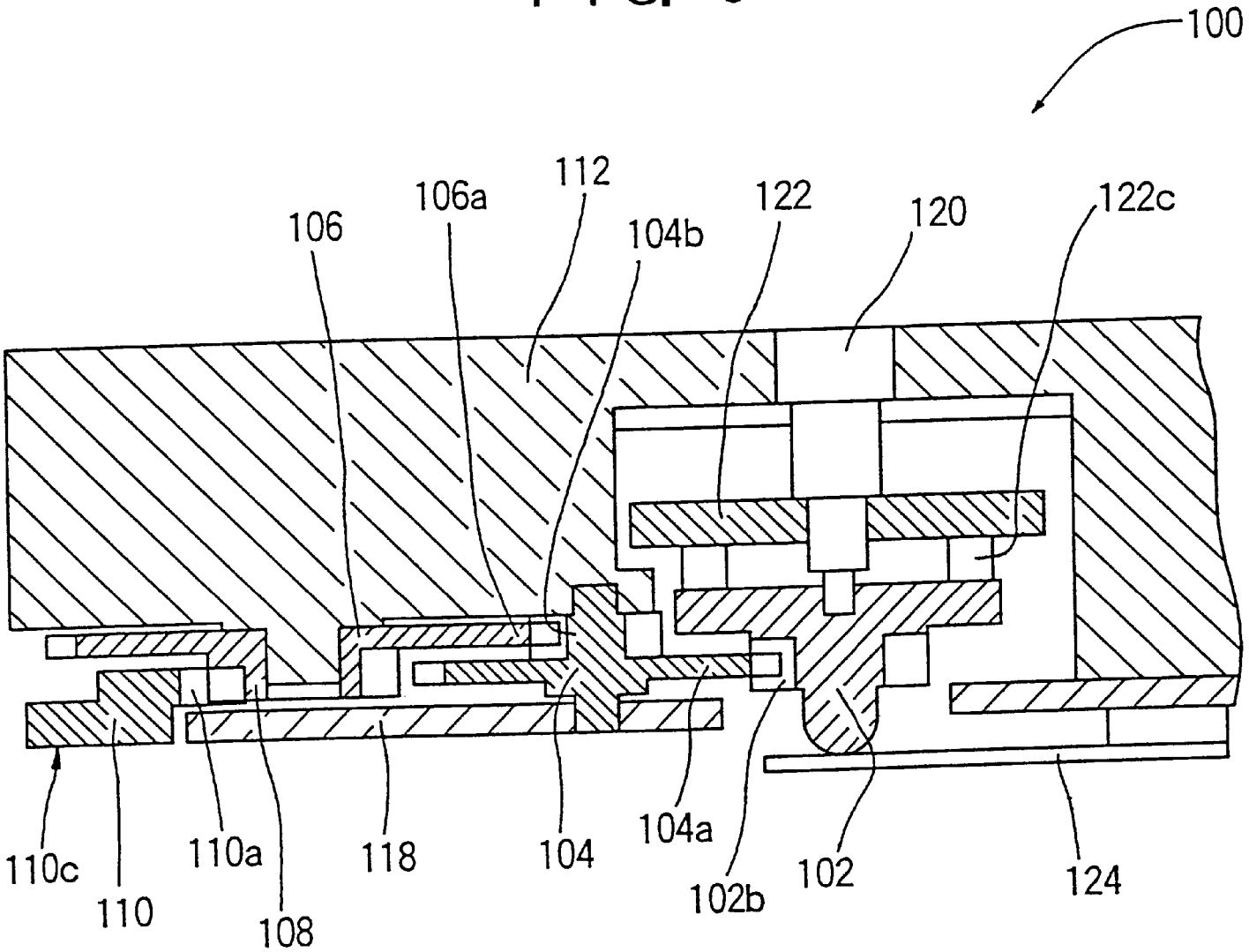
[FIG. 3] A schematic sectional view showing another structure of a calendar mechanism portion of the first embodiment of the calendar electronic timepiece of the present invention.

In another structure shown in FIG. 3, an ultrasonic rotor axle 120 is fixed to a main plate 112. The ultrasonic rotor axle 120 has an ultrasonic stator 122 fixed thereon. The ultrasonic stator 122 has a piezoelectric element (not shown) firmly fixed thereon. A ultrasonic rotor 102 is rotatably assembled on the ultrasonic rotor axle 120, and contacted with a displacement-magnifying comb teeth 122*c* of the ultrasonic stator 122. An ultrasonic spring 124 urges the ultrasonic rotor 102 so as to apply an elastic force to the displacement-magnifying comb teeth 122*c*.

An intermediate date driving wheel 104 is assembled between the main plate 112 and the date dial holder 118. The ultrasonic rotor 102 has an ultrasonic rotor kana 102*b* in mesh with intermediate date driving gear 104*b* of the intermediate date driving wheel 104. A date driving wheel 106 is rotatably assembled on the main plate 112. The intermediate date driving wheel 104 has a intermediate date driving kana 104*b* in mesh with the date driving gear 106*a* of the date driving wheel 106.

The date drive wheel 106 has a date finger 106 provided thereon so as to be rotated by the date wheel 106 simultaneously therewith. A date dial having 31 date teeth 110*a* is rotatably assembled on the main plate 112. The date dial 110 has numerals "1" to "31" on indicating surfaces 110*c* thereof.

Then, explanations will be made on the operation of the first embodiment of the calendar electronic timepiece 100.

Figure 4:
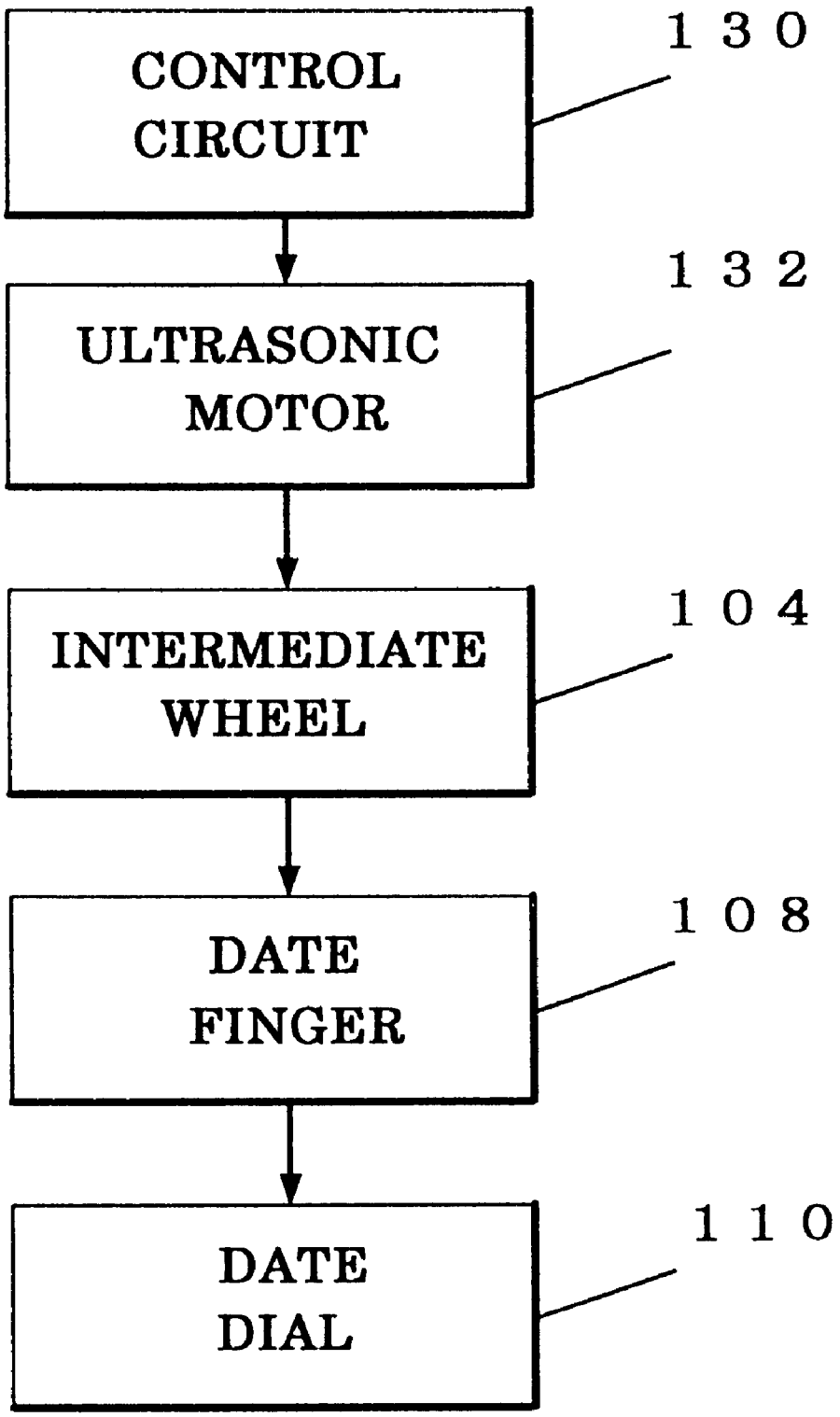
[FIG. 4] A schematic block diagram showing the calendar mechanism portion of the first embodiment of the calendar electronic timepiece of the present invention.

Referring to FIG. 4, a control circuit 130 has a time signal generating circuit for counting information on time and date to generate a date signal, and further an ultrasonic motor driving circuit for outputting an ultrasonic motor driving signal to drive an ultrasonic motor (USM) based on the date signal outputted by the time signal generating circuit.

Figure 27:
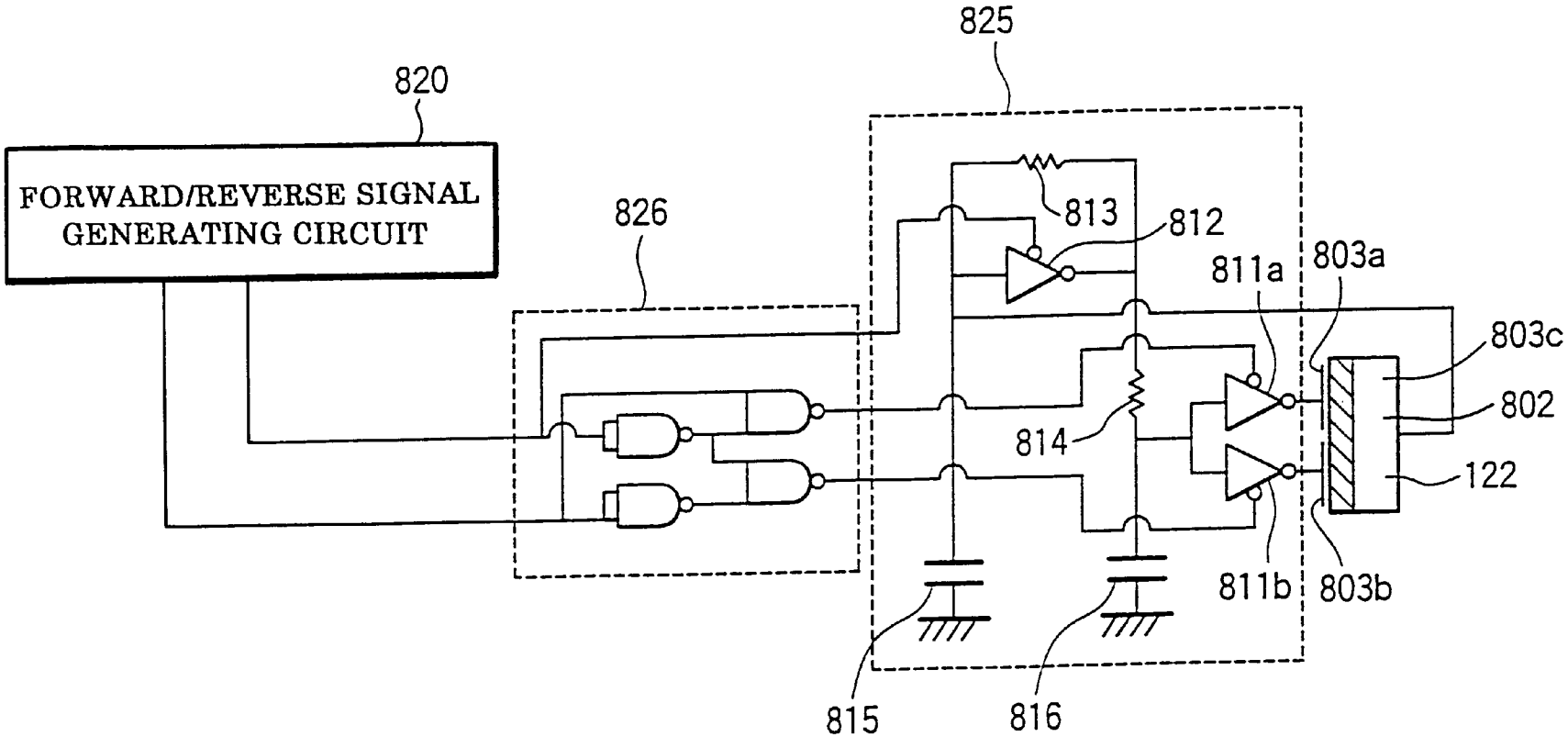
[FIG. 27] A block diagram showing a structure of a driving circuit for an ultrasonic motor of the embodiment of the calendar electronic timepiece of the present invention.

Referring to FIG. 27, the ultrasonic stator 122, constituting a vibrating member of the ultrasonic motor, is bonded with, on one surface, a piezoelectric element 802 formed with two sets of electrode groups 803*a*, 803*b* having a plurality of electrodes. An oscillation drive circuit 825 is connected to the electrode groups 803*a*, 803*b* of the piezoelectric element 802. An inverter 812 serves as an inverting power amplifier for amplifying an electric signal as excitation information from electrodes 803*c* formed on one surface formed with the electrode groups 803*a*, 803*b* and the other end or the ultrasonic stator 122. A resistor 813 is connected in parallel with the inverter 812 to stabilize for an operating point of the inverter 812.

The inverter 812 has an output terminal connected to input terminals of two sets of buffers 811*a*, 811*b*. Each of the output terminals of the two buffers 811*a*, 811*b* is connected to the electrode group 803*a*, 803*b*. A capacitor 815 has one end connected to the input terminal of the inverter 812, while a capacitor 816 has one end connected through a resistor 814 to the output terminal of the inverter 812. The capacitors 815, 816 have the other end being grounded to perform phase adjustment within the oscillation drive circuit 825.

The inverter 812 and the buffers 811*a*, 811*b* respectively has, at input terminals and output terminals, control terminals so that they are an inverter and a buffer of a tri-state structure that is capable of bringing the output terminal into a high impedance state depending upon the inputting signal to the control terminal.

A forward/reverse signal generating means 820 outputs a forward/reverse signal for setting a rotational direction of the ultrasonic motor to a switching circuit 826. The switching circuit has output terminals respectively connected to the control terminals of the tri-state buffers 811*a*, 811*b* and the tri-state inverter 812 of the oscillation drive circuit 825, so as to cause one of the tri-state buffers 811*a*, 811*b* to function as a usual buffer and the other buffer at its output terminal to be in a high impedance state for being disabled.

The ultrasonic stator 122 is driven by the tri-state buffer that functions as a usual buffer that is selected by the output signal of the switching circuit 826. The ultrasonic stator 122 is driven only by the tri-state buffer that is allowed to function as a usual buffer by the switching circuit 826. When the tri-sate buffer allowed to function as a usual buffer is changed over by the switching circuit 826, the ultrasonic motor is reversed of rotational direction.

The tri-state inverter can be placed at its output terminal in the high impedance state by the output signal of the switching circuit 826 that is outputted based on the output of the forward/reverse signal generating means 820. When the tri-state inverter becomes disabled, the tri-state buffers 811*a*, 811*b* are both disabled so that the ultrasonic motor can be stopped.

Figure 28:
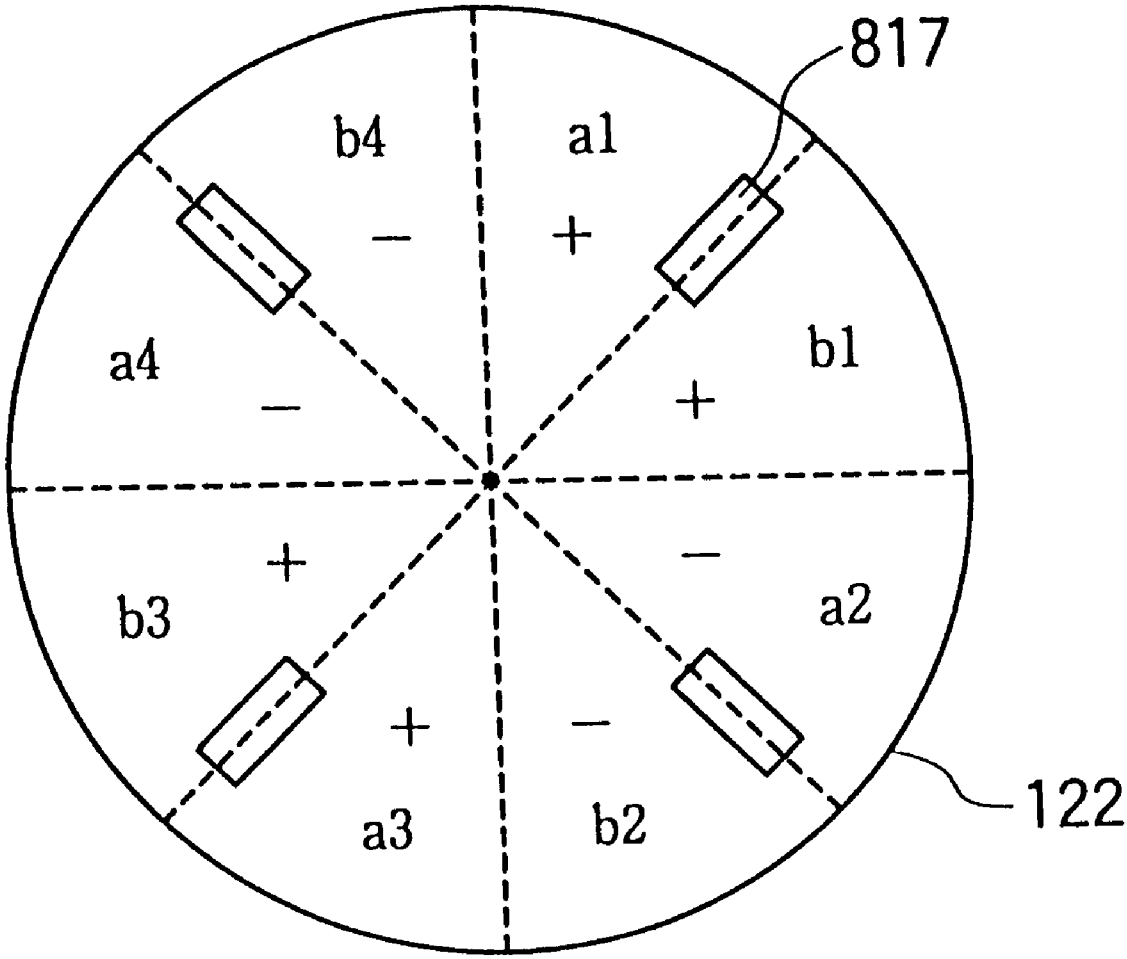
[FIG. 28] A plan view of an ultrasonic stator of the ultrasonic motor of the embodiment of the calendar electronic timepiece of the present invention.
Figure 29:
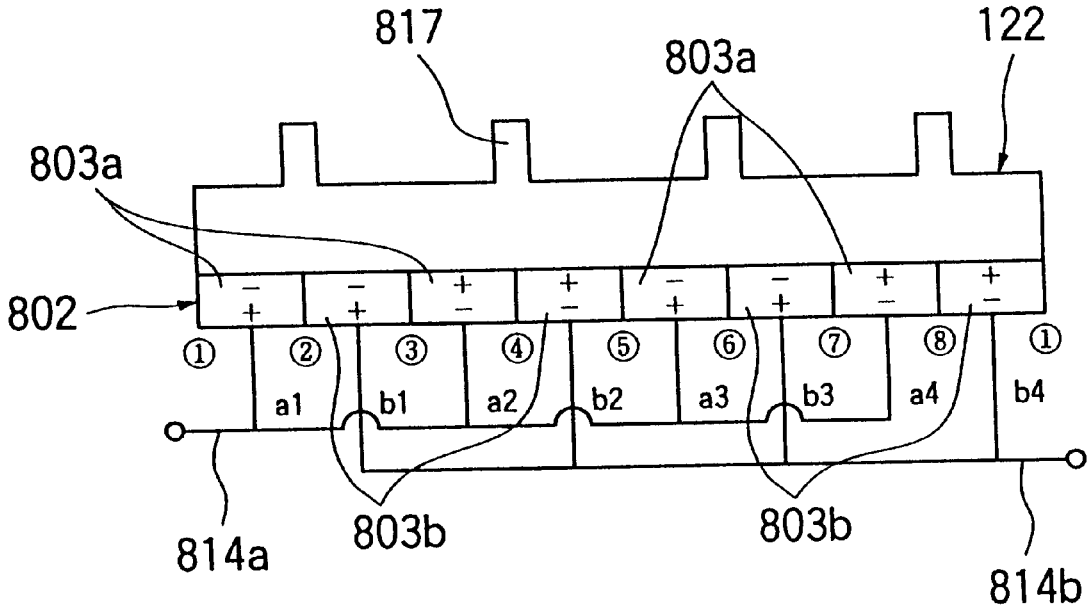
[FIG. 29] A sectional view of the ultrasonic stator of the ultrasonic motor of the embodiment of the calendar electronic timepiece of the present invention.

Referring to FIG. 28 and FIG. 29, a disc-shaped ultrasonic stator 122 has a disc-shaped piezoelectric element 802 joined to a flat surface thereof by adhesion or thin-film formation, or the like. The ultrasonic motor causes standing wave oscillation with two wavelengths in a circumferential direction of the ultrasonic stator 122, rotatably driving the ultrasonic rotor. The piezoelectric element 802 is formed, at one flat surface, with eight-segmented electrodes having four times the number of waves in the circumferential direction, to provide an alternate arrangement with a first electrode group 803*a* and a second electrode group 803*b* through polarization-treating to (+) and (−), as shown in FIG. 28 and FIG. 29.

The first electrode group 803*a* is structured by electrodes a1, a2, a3, a4, each of which electrodes is short circuited by a connection means 814*a*. The second electrode group 803*a* is structured by electrodes b1, b2, b3, b4, each of which electrodes is short circuited by a connection means 814*b*.

In the figure, (+) and (−) denotes directions of polarization treatments, which are respectively treated of polarization by applying positive and negative electric fields through a joint surface side of the piezoelectric elements to the ultrasonic stator 122.

The ultrasonic stator 122 is provided, at a surface thereof and around boundaries of the electrodes, with projections (comb teeth) 817 for magnifying the displacement of the ultrasonic stator and transmitting a drive force from the ultrasonic stator to the ultrasonic rotor.

The ultrasonic stator 122 is driven by applying a radio frequency voltage generated by the oscillation drive circuit 825 to either one of the electrode groups 803*a* or 803*b*. The rotational direction of the ultrasonic motor can be switched over depending upon which electrode group the ultrasonic stator 122 is driven with.

It is preferred that the ultrasonic motor used for the calendar electronic timepiece of the present invention is driven by the above structure formed by the drive circuit, the piezoelectric element and the ultrasonic stator. However, it is possible to drive it by other structures.

The control circuit 130, when outputting a count result of zero o'clock a.m., outputs an ultrasonic motor drive signal to the ultrasonic motor (USM) 132. That is, the control circuit 130 is structured so as to output an ultrasonic motor drive signal for rotating the date dial 110 by 360°/31, i.e. a 1/31 rotation, once a day.

The control circuit 130 counts for "year", "month", "day" and hour. When the control circuit 130 outputs a count result of zero o'clock a.m. for a usual day, it outputs an ultrasonic motor drive signal corresponding to the usual day to the ultrasonic motor (USM) 132. That is, the control circuit 130 is structured so as to output an ultrasonic motor drive signal for rotating the date dial 110 by 360°/31, i.e. a 1/31 rotation, once a day.

Also, when the control circuit 130 outputs a count result of zero o'clock a.m. of March 1 of a year not falling on a leap year, e.g. March 1 of 1997, the control circuit 130 outputs an ultrasonic motor drive signal corresponding to March 1 to the ultrasonic motor (USM) 132. That is, the control circuit 130 is structured so as to output an ultrasonic motor drive signal for rotating the date dial 110 by (360°/31)×4, i.e. a 4/31 rotation. Therefore, the information on the "day" indicated by the date dial 110 is changed from an indication "28" corresponding to February 28 to an indication "1" corresponding to March 1, without indicating "29", "30" and "31".

Also, when the control circuit 130 outputs a count result of zero o'clock a.m. of March 1 of a leap year, e.g. March 1 of 2000, the control circuit 130 outputs an ultrasonic motor drive signal corresponding to March 1 of the leap year to the ultrasonic motor (USM) 132. That is, the control circuit 130 is structured so as to output an ultrasonic motor drive signal for rotating the date dial 110 by (360°/31)×3, i.e. a 3/31 rotation. Therefore, the information on the "day" indicated by the date dial 110 is changed from an indication "29" corresponding to February 29 to an indication "1" corresponding to March 1, without indicating "30" and "31".

Similarly, when the control circuit 130 outputs a count result of a next day, i.e. "30th" to a last day of a "small" month, e.g. 0 o'clock a.m. of May 1st, the control circuit 130 outputs an ultrasonic motor drive signal corresponding to May 1st to the ultrasonic motor (USM) 132. That is, the control circuit 130 is structured to output an ultrasonic motor drive circuit for rotating the date dial 110 by (360°/31)×2, i.e. a 2/3 rotation. Consequently, the information about the "day" indicated by the date dial 110 is changed from an indication "30" for April 30th to an indication "1" for May 1st, without indicating "31".

The structure like this is similarly applicable to another embodiment of the present invention.

By structuring as above, the calendar electronic timepiece constitutes a "auto-calendar timepiece" or a "perpetual calendar timepiece".

The ultrasonic motor (USM) 132 has an ultrasonic stator joined with a piezoelectric element and an ultrasonic rotor frictionally driven by vibratory waves generated in the ultrasonic stator due to inputting of an ultrasonic motor drive signal for expanding and shrinking the piezoelectric element.

The piezoelectric element is formed, at a surfaces, at least two sets of electrode groups formed by a plurality of electrodes. The control circuit 130 has at least two power amplifiers. These power amplifiers has output terminals respectively connected to two sets of electrode groups to independently drive the electrode.

The ultrasonic rotor of the ultrasonic motor (USM) 132 is rotated upon inputting an ultrasonic motor drive signal to the electrode group of the piezoelectric element. The rotation of the ultrasonic rotor causes rotation of the intermediate wheel, i.e. the intermediate date drive wheel 104. The rotation of the intermediate date drive wheel rotates the date finger 108, and the date finger 108 causes the date dial 110 to rotate.

Incidentally, it is also possible for the calendar electronic timepiece of the present invention to have a calendar indicating wheel for indicating other calendar information, e.g. "year", "month", "day of the week", "six day of the week", etc.

For example, in a structure having a day indicator for indicating "day of the week", a day indicator (not shown) having 28 day indicator teeth (not shown) is rotatably assembled on a main plate 112.

There are provided fourteen kinds of characters of "GETU", "MON", "KA", "TUE", "SUI", "WED", "MOKU", "THU", "KIN", "FRI", "DO", "SAT", "NICHI", and "SUN" on indicating surfaces of the day indicator.

The control circuit 130 has a time signal generating circuit for counting information on time of the day and day of the week to generate a day-of-the-week signal, and further an ultrasonic motor drive circuit for outputting an ultrasonic motor drive signal for rotating the ultrasonic motor based on the day-of-the-week signal outputted by the time signal generating circuit.

The control circuit 130, when outputting a count result of zero o'clock a.m., outputs an ultrasonic motor drive signal to the ultrasonic motor (USM) 132. That is, the control circuit 130 is structured to output an ultrasonic motor drive signal to rotate the day indicator by 360°/14, i.e. a 1/14 rotation, once a day.

Therefore, if the days of the week in Japanese are first set, or if the days of the week in English are set, the day of the week can be indicated in Japanese or English, as required, by the day indicator.

Also, in a structure having a day indicator for indicating "month", a month dial (not shown) having 36 month-wheel teeth (not shown) is rotatably assembled on a main plate 112. The numerals of from "1" to "12" are provided in three sets in order on indicating surfaces of the month dial. That is the month dial is provided with totally 36 numerals, such as 1–12, 1–12, 1–12, on the indicating surfaces thereof.

The control circuit 130 has a time signal generating circuit for counting information on time of the day and month to generate a month signal, and further an ultrasonic motor drive circuit for outputting an ultrasonic motor drive signal for rotating the ultrasonic motor based on the month signal outputted by the time signal generating circuit.

The control circuit 130, when outputting a count result of 1st day of the month, outputs an ultrasonic motor drive signal to the ultrasonic motor (USM) 132. That is, the control circuit 130 is structured to output an ultrasonic motor drive signal to rotate the month indicator by 360°/36, i.e. 1/36 rotation, on every 1st day of the month.

Therefore, the month can be indicated by the month indicator.

It is also possible to indicate "year", "six days of the week" etc. by a similar structure.

(2) Second Embodiment

Figure 5:
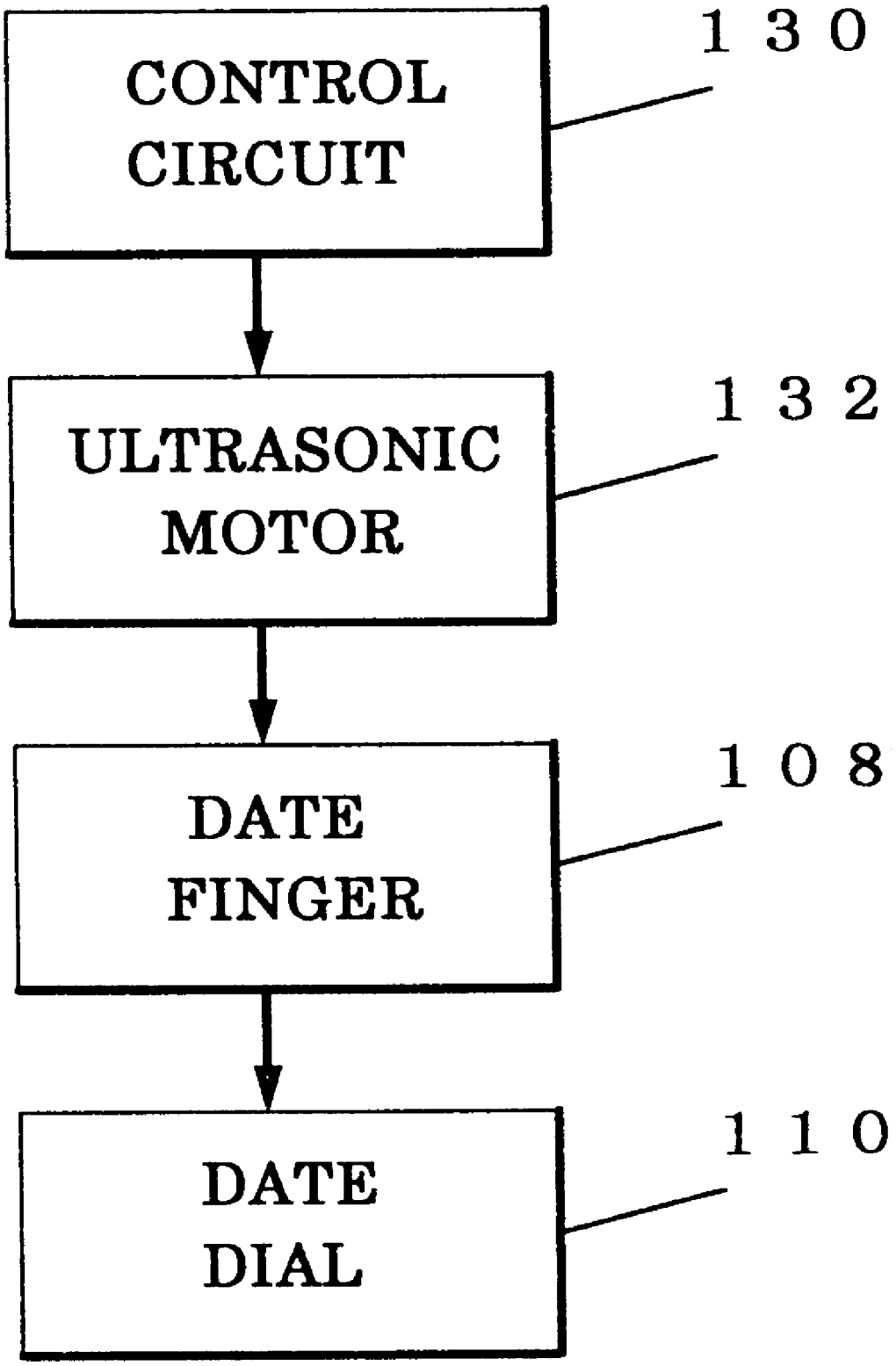
[FIG. 5] A schematic block diagram showing a calendar mechanism portion of a second embodiment of the calendar electronic timepiece of the present invention.
Figure 6:
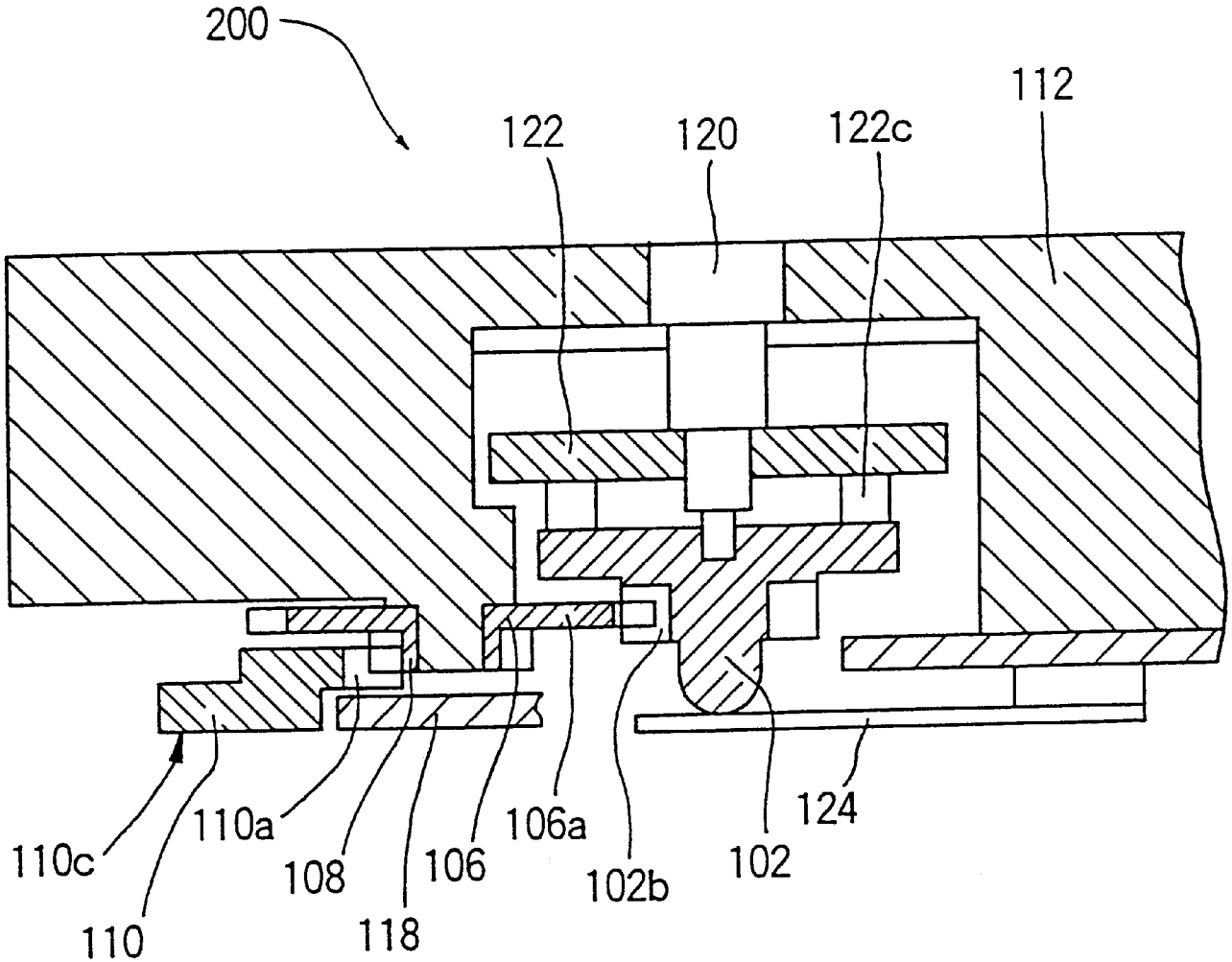
[FIG. 6] A schematic sectional view showing the calendar mechanism portion of a second embodiment of the calendar electronic timepiece of the present invention.

Referring to FIG. 5 and FIG. 6, the structure of an ultrasonic motor of a second embodiment of a calendar electronic timepiece 200 of the present invention is similar to the ultrasonic motor of the first embodiment of the calendar electronic timepiece 200 of the present invention shown in FIG. 3.

A date driving wheel 106 is rotatably assembled on a main plate 112. A ultrasonic rotor 102 has an ultrasonic rotor kana 102*b* is in mesh with date driving gear 106*a* of the date driving wheel 106*a*.

A date finger 108 is provided on the date driving wheel 106 so as to be simultaneously rotated by the rotation of the date driving wheel 106. A date dial 110 having 31 of date dial teeth 110*a* is assembled on the main plate 112. Numerals of from "1" to "31" (not shown) are provided on indicating surfaces 110*c* of the date dial 110.

The calendar electronic timepiece 200 is provided with a date jumper (not shown). The date jumper has a rectifying portion for rectifying the date dial teeth 110*a*.

Then, explanations will be made on the operation of the second embodiment of the calendar timepiece 200 of the present invention.

Referring to FIG. 5, the control circuit 130 has a time signal generating circuit for counting information on time of the day and date to generate a date signal, and further an ultrasonic motor drive circuit for outputting an ultrasonic motor drive signal for rotating the ultrasonic motor based on the date signal outputted by the time signal generating circuit.

The control circuit 130, when outputting a count result of zero o'clock a.m., outputs an ultrasonic motor drive signal to the ultrasonic motor (USM) 132. That is, the control circuit 130 is structured to output an ultrasonic motor drive signal to rotate the date dial by 360°/31, i.e. 1/31 rotation, once a day.

The ultrasonic motor (USM) 132 has an ultrasonic rotor that is rotated by inputting an ultrasonic motor drive signal to the electrode group of the piezoelectric element. The rotation of the ultrasonic rotor rotates the date finger 108 so that the date finger 108 caused the date dial 110 to rotate.

(3) Third Embodiment

Figure 7:
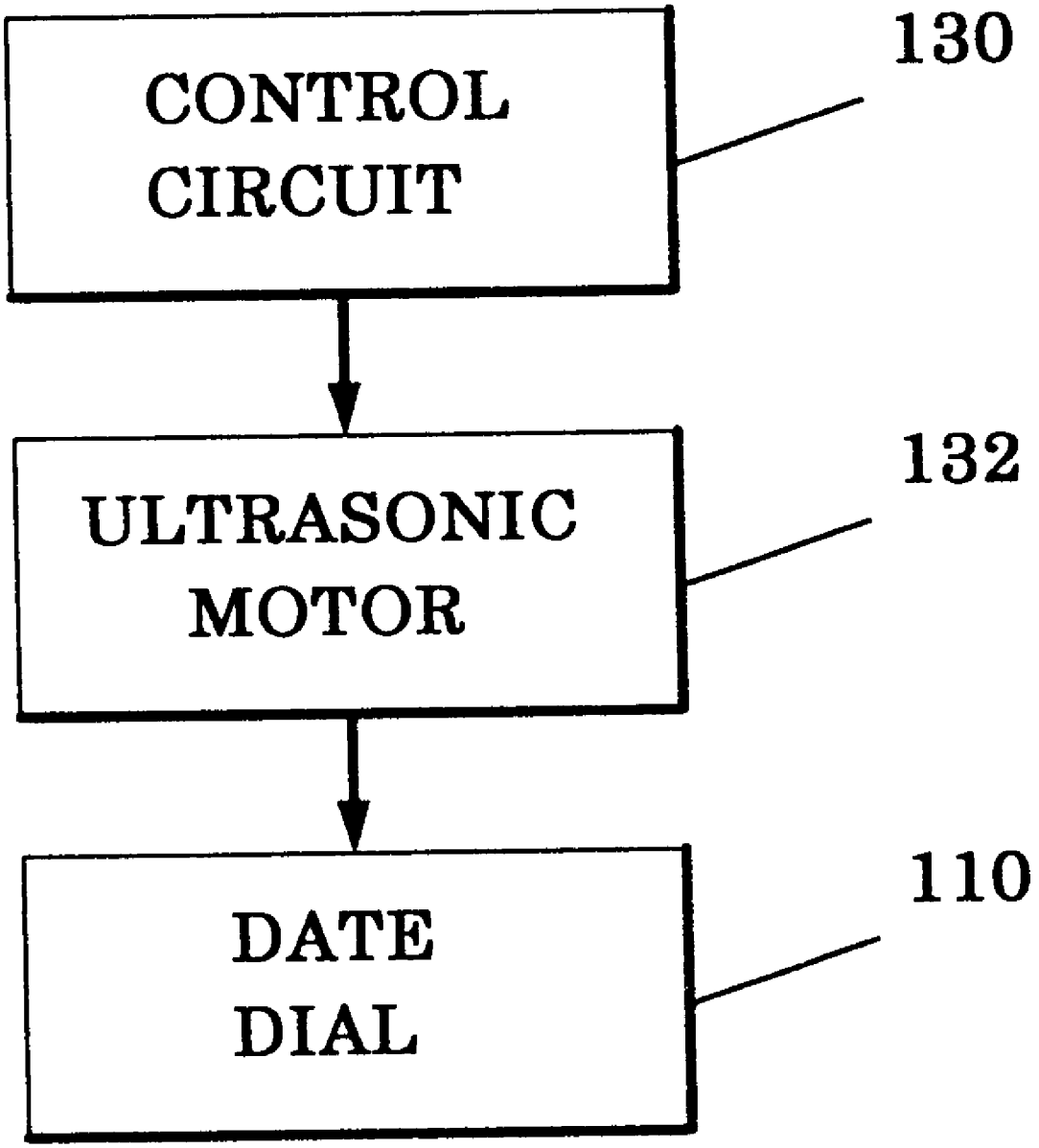
[FIG. 7] A schematic block diagram showing a calendar mechanism portion of a third embodiment of the calendar electronic timepiece of the present invention.
Figure 8:
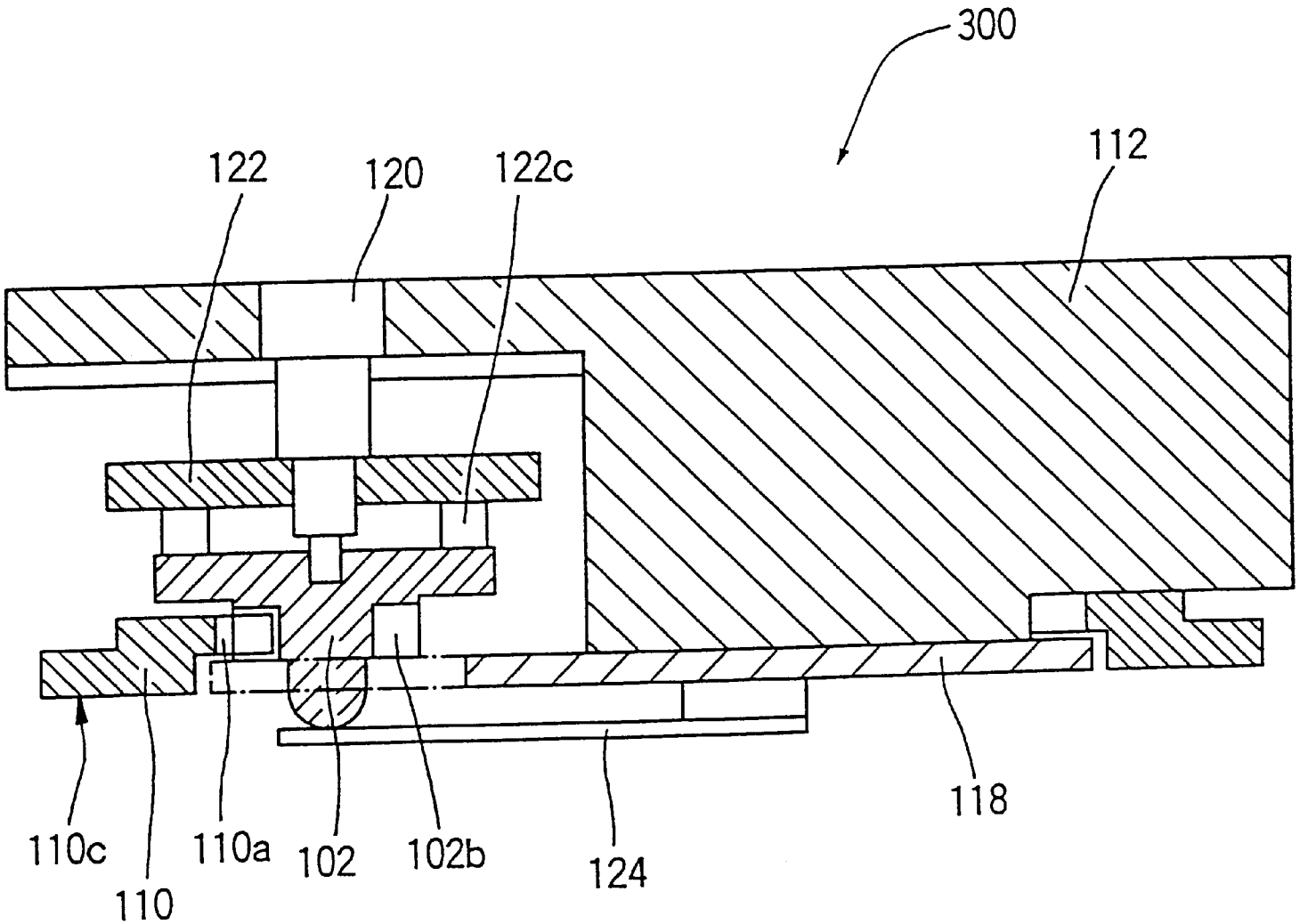
[FIG. 8] A schematic sectional view showing a calendar mechanism portion of a third embodiment of the calendar electronic timepiece of the present invention.

Referring to FIG. 7 and FIG. 8, the structure of an ultrasonic motor of a third embodiment of a calendar electronic timepiece 300 of the present invention is similar to the ultrasonic motor (USM) 132 of the first embodiment of the calendar electronic timepiece 200 of the present invention shown in FIG. 3.

A date dial 110 is rotatably assembled on a main plate 112. A ultrasonic rotor 102 has an ultrasonic rotor kana 102*b* is in mesh with date dial teeth 110*a* of the date driving wheel 106*a*. Numerals of from "1" to "31" (not shown) are provided on indicating surfaces 110*c* of the date dial 110.

The calendar electronic timepiece 300 is provided with a date jumper (not shown). The date jumper has a rectifying portion for rectifying the date dial teeth 110*a*.

Then, explanations will be made on the operation of the second embodiment of the calendar timepiece 300 of the present invention.

Referring to FIG. 7, the control circuit 130 has a time signal generating circuit for counting information on time of the day and date to generate a date signal, and further an ultrasonic motor drive circuit for outputting an ultrasonic motor drive signal for rotating the ultrasonic motor based on the date signal outputted by the time signal generating circuit.

The control circuit 130, when outputting a count result of zero o'clock a.m., outputs an ultrasonic motor drive signal to the ultrasonic motor (USM) 132. That is, the control circuit 130 is structured to output an ultrasonic motor drive signal to rotate the date dial by 360°/31, i.e. a 1/31 rotation, once a day.

The ultrasonic motor (USM) 132 has an ultrasonic rotor that is rotated by inputting an ultrasonic motor drive signal to the electrode group of the piezoelectric element. The rotation of the ultrasonic rotor rotates the date finger 108 so that the date finger 108 caused the date dial 110 to rotate.

(4) Fourth Embodiment

Figure 9:
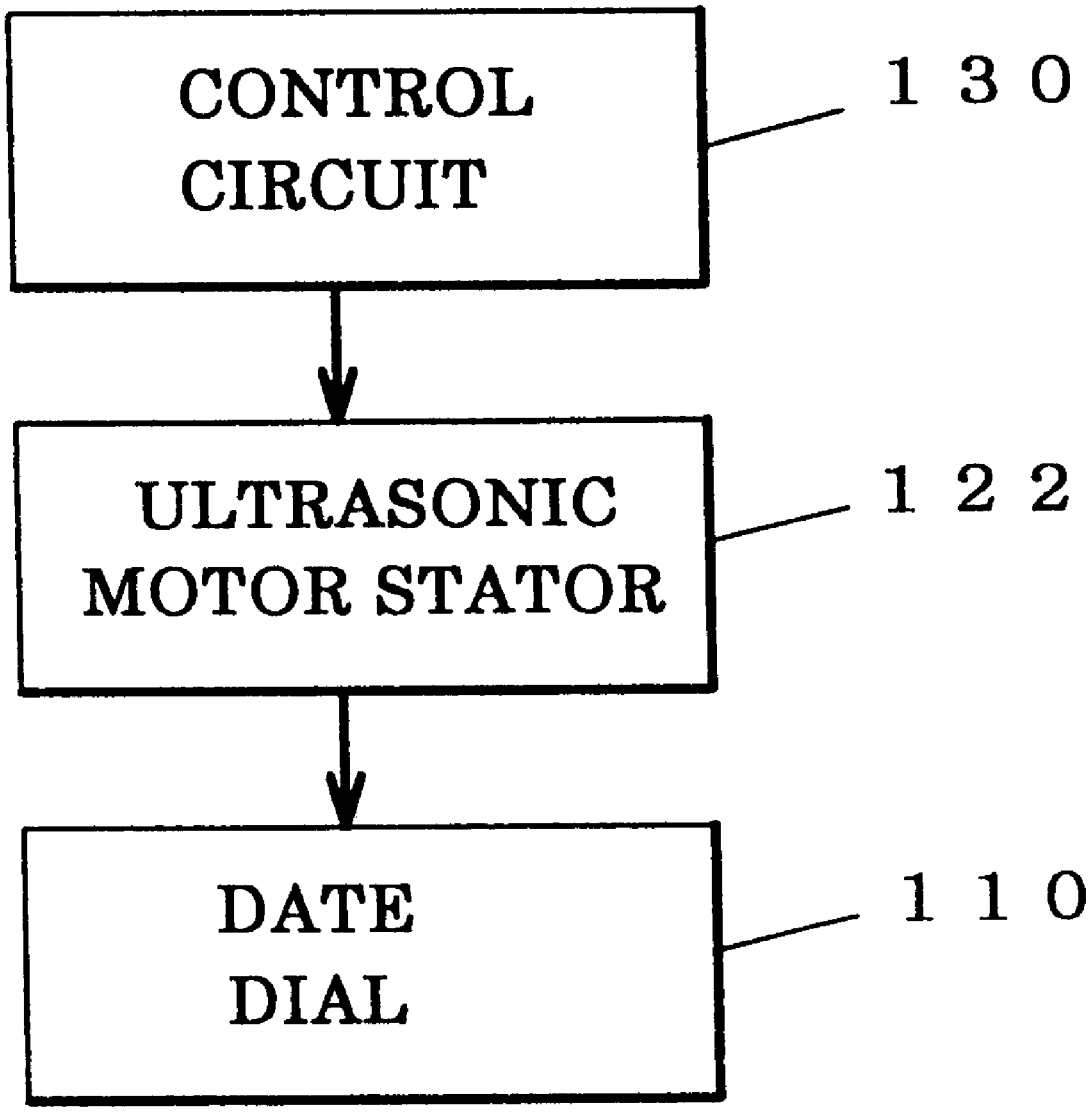
[FIG. 9] A schematic block diagram showing a calendar mechanism portion of a fourth embodiment of the calendar electronic timepiece of the present invention.
Figure 10:
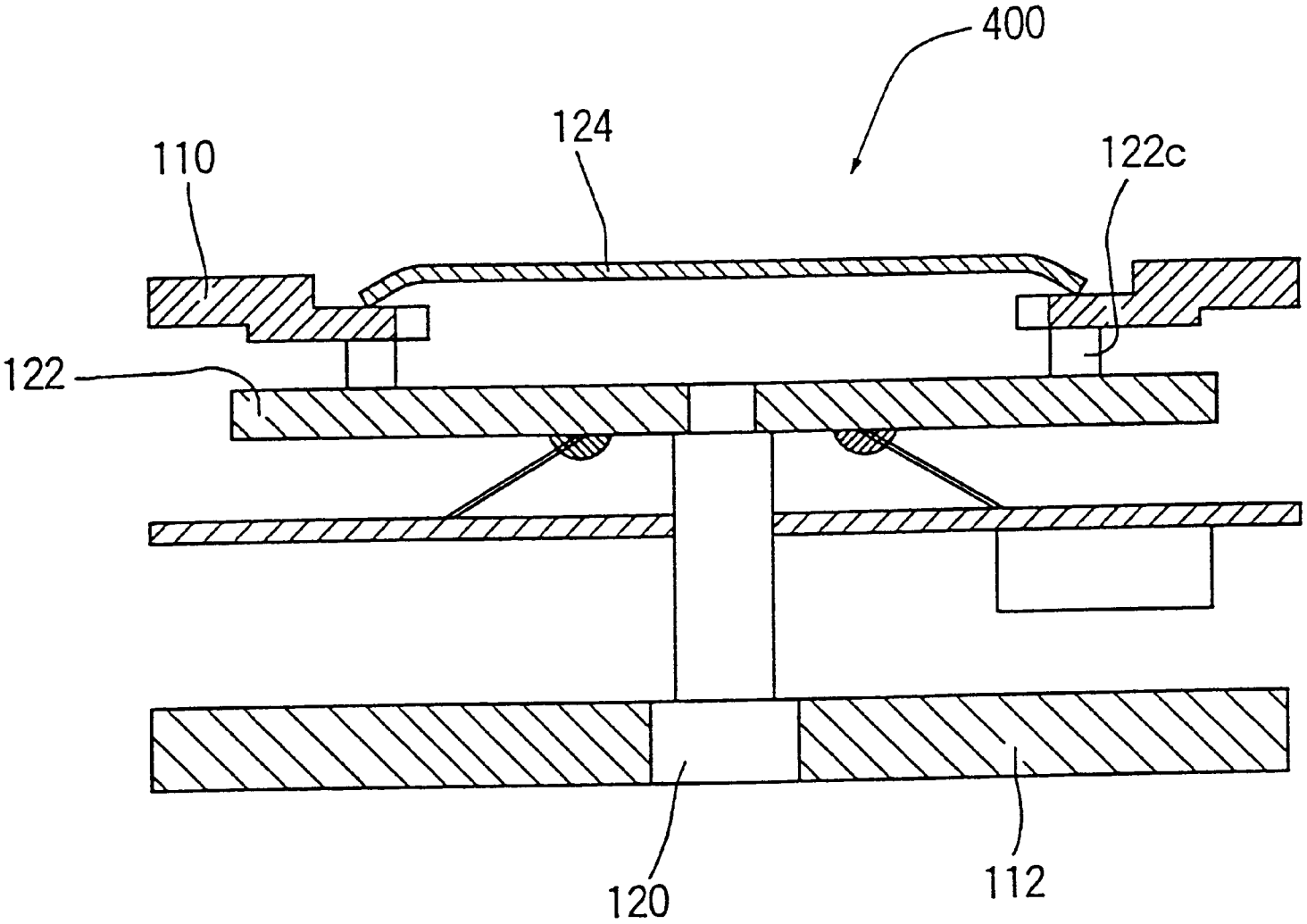
[FIG. 10] A schematic sectional view showing the calendar mechanism portion of the fourth embodiment of the calendar electronic timepiece of the present invention.

Referring to FIG. 9 and FIG. 10, a calendar electronic timepiece 400 of the present invention has an ultrasonic rotor axle 120 fixed on the main plate 112. An ultrasonic stator (USM) stator 122 is fixed on the rotor axle 120. A piezoelectric element (not shown) is firmly fixed to the ultrasonic stator 122. A date dial 110 contacts with displacement-magnifying comb teeth 122*c* of the ultrasonic stator 122. That is, the date dial 110 constitutes the ultrasonic rotor 102.

A ultrasonic spring 124 urges the date dial 110 in a manner applying an elastic force to the displacement-magnifying comb teeth.

A calendar electronic timepiece 400 is provided with a date jumper (not shown). The date jumper has a rectifying portion to rectify the dial teeth 110*a*.

Then, explanations will be made on the operation of the fourth embodiment of the calendar electronic timepiece 400 of the present invention.

Referring to FIG. 9, the control circuit, the control circuit 130 has a time signal generating circuit for counting information on time of the day and date to generate a date signal, and further an ultrasonic motor drive circuit for outputting an ultrasonic motor drive signal for rotating the ultrasonic motor based on the date signal outputted by the time signal generating circuit.

The control circuit 130, when outputting a count result of zero o'clock a.m., outputs an ultrasonic motor drive signal to the ultrasonic motor (USM) 132. That is, the control circuit 130 is structured to output an ultrasonic motor drive signal to rotate the date dial 110 by 360°/31, i.e. a 1/31 rotation, once a day.

The ultrasonic motor (USM) has the ultrasonic stator 122 joined with a piezoelectric element.

The date dial 110 is frictionally driven by vibratory waves generated on the ultrasonic stator due to expansion of the piezoelectric element when the piezoelectric signal is inputted with an ultrasonic motor drive signal.

(5) Fifth Embodiment

Figure 11:
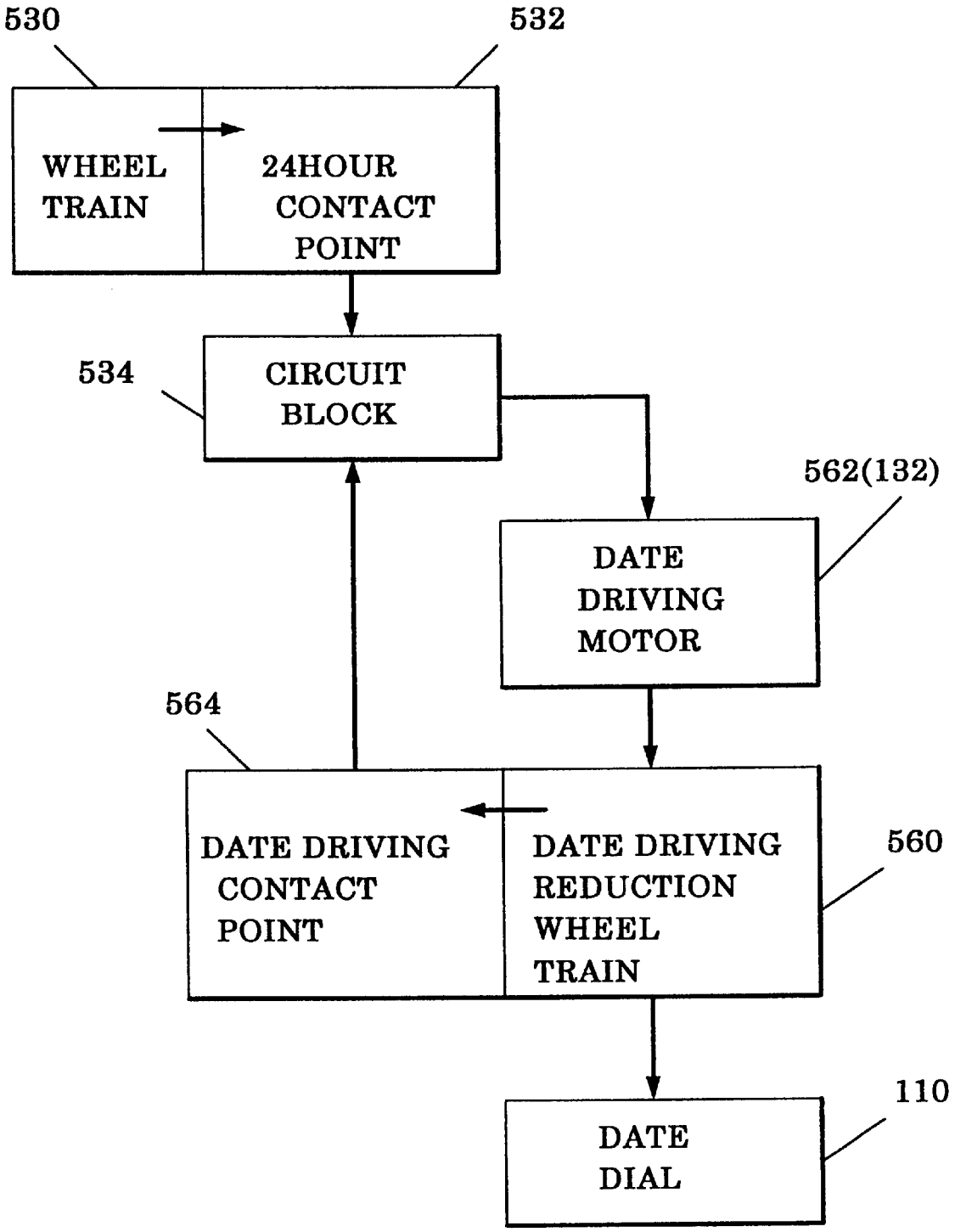
[FIG. 11] A schematic block diagram showing a calendar mechanism portion of a fifth embodiment of the calendar electronic timepiece of the present invention.
Figure 12:
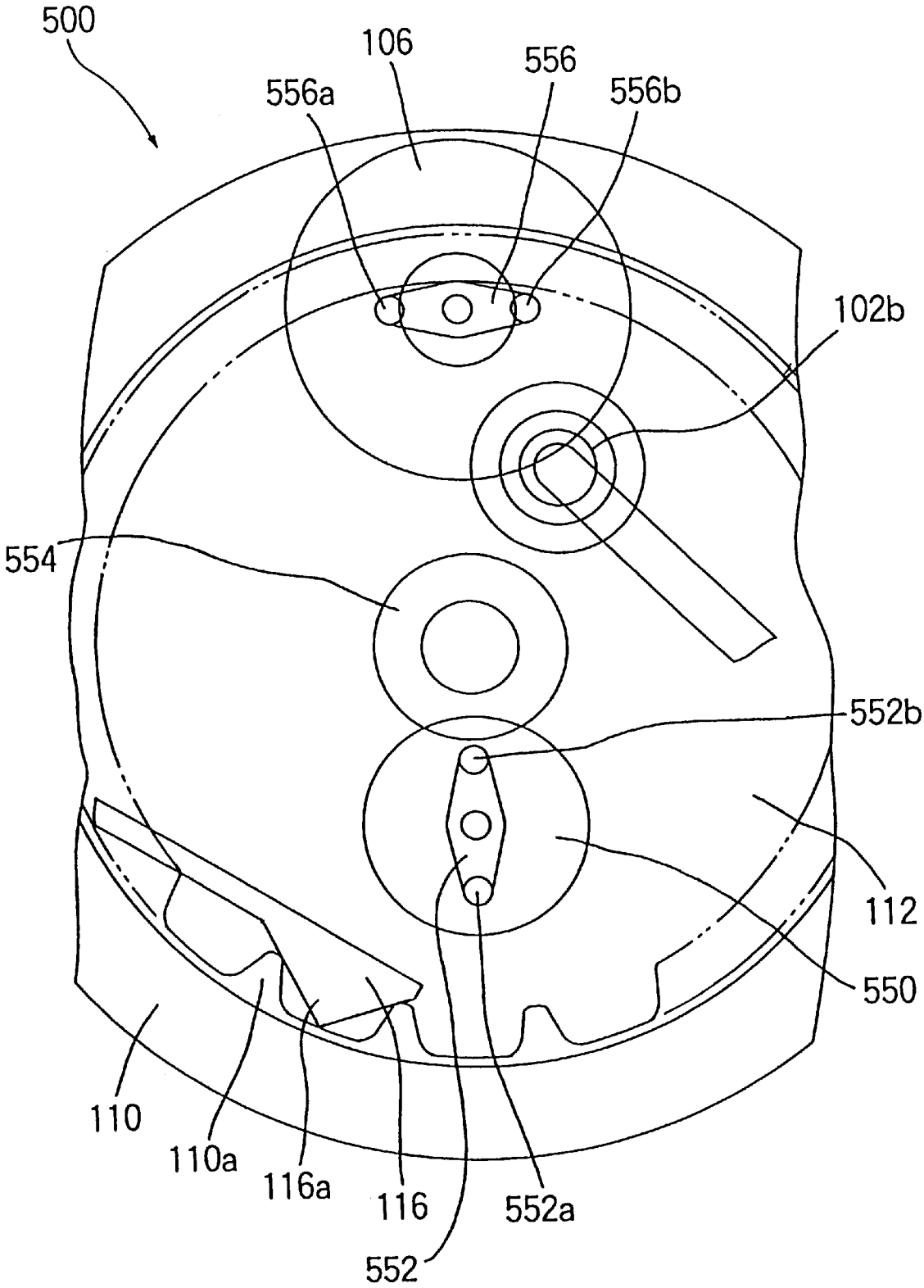
[FIG. 12] A schematic plan view (projection view) showing a calendar mechanism portion of a fifth embodiment of the calendar electronic timepiece of the present invention.
Figure 13:
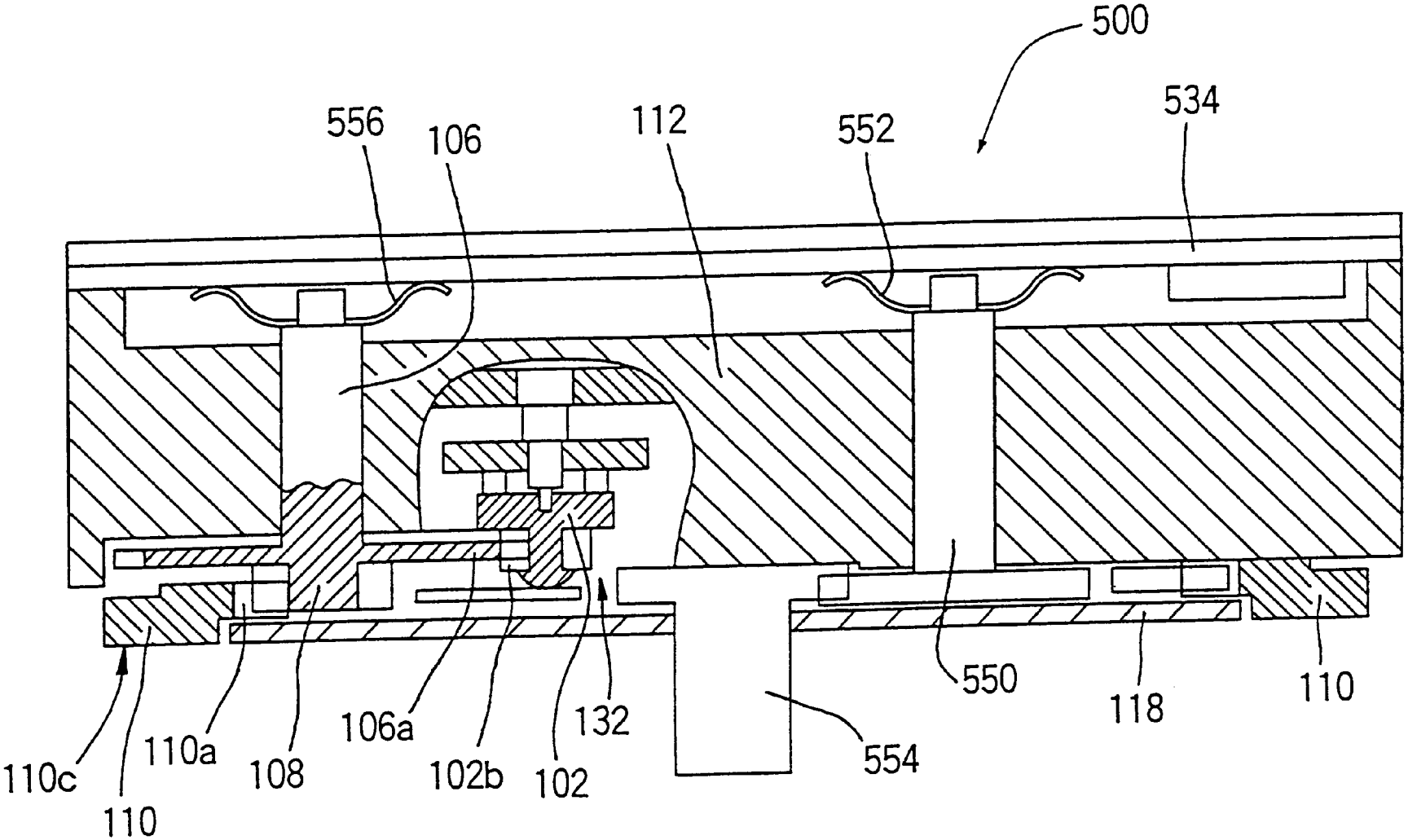
[FIG. 13] A schematic sectional view showing the calendar mechanism portion of the fifth embodiment of the calendar electronic timepiece of the present invention.

Referring to FIG. 11 through FIG. 13, a fifth embodiment of a calendar electronic timepiece 500 has a wheel train having, at a part thereof, a 24 h contact 532 for detecting a rotational position of the wheel train 530. A 24-hour wheel 550 has a 24-o'clock contact point spring 552. The 24-hour contact point spring 552 has two 24-o'clock contact point spring terminals 552*a* and 552*b*.

A circuit block 534 is provided with a pattern for the 24-o'clock contact point spring terminals (not shown) that is formed corresponding to a portion of a circumferential portion along a path of rotation of tips of the 24-hour contact point spring terminals 552*a* and 552*b*. The 24-o'clock contact point spring 552 is arranged contactable with the 24-o'clock contact point spring terminal pattern (not shown) of the circuit block 534.

The 24-hour wheel 550 is in mesh with a hour wheel 554, and rotated one per day. The hour wheel 554 makes one rotation per 12 hours to indicate an "hour" by a hour hand (not shown) attached to the hour wheel.

A date driving wheel 106 is rotatably assembled on the main plate 112. The date driving wheel 106 constitute a date driving reduction wheel train 560. The ultrasonic rotor 102 of the ultrasonic motor 132 has a ultrasonic rotor kana 102*b* in mesh with a date driving gear 106 of the date driving wheel 106. The ultrasonic motor including the ultrasonic rotor 102 constitutes a date driving motor 562.

A date finger 108 is provided on the date driving wheel 106 so that it is simultaneously rotated by rotation of the date driving wheel 106. A date dial 110 having 31 of date dial teeth 110*a* is rotatably assembled on the main plate 112. Numerals of from "1" to "31" (not shown) are provided on surfaces 110*c* of the date dial 110. A date dial holder 118 rotatably holds the date dial 110.

The calendar electronic timepiece 500 is provided with a date jumper 116. The date jumper 116 has a rectifying portion 116*a* to rectify the date dial teeth 110*a*.

The date driving wheel 106 has a date driving wheel contact point spring 556. The date driving wheel contact point spring 556 has two date driving wheel contact point spring terminals 556*a* and 556*b*.

A circuit block 534 is provided with a pattern for the date driving wheel contact point spring terminals (not shown) that is formed corresponding to a portion of a circumferential portion along a path of rotation of tips of the date driving wheel contact point spring terminals 556*a* and 556*b*. The date driving wheel contact point spring 556 is arranged contactable with the date driving wheel contact point spring terminal pattern (not shown) of the circuit block 534. The date driving wheel contact point spring 556 constitutes a date driving contact 564.

Then, explanations will be made on detailed structures of a contact portion for detecting a position in rotational direction of a transmitting wheel contained in the wheel train of the calendar electronic timepiece of the present invention.

Figure 30:
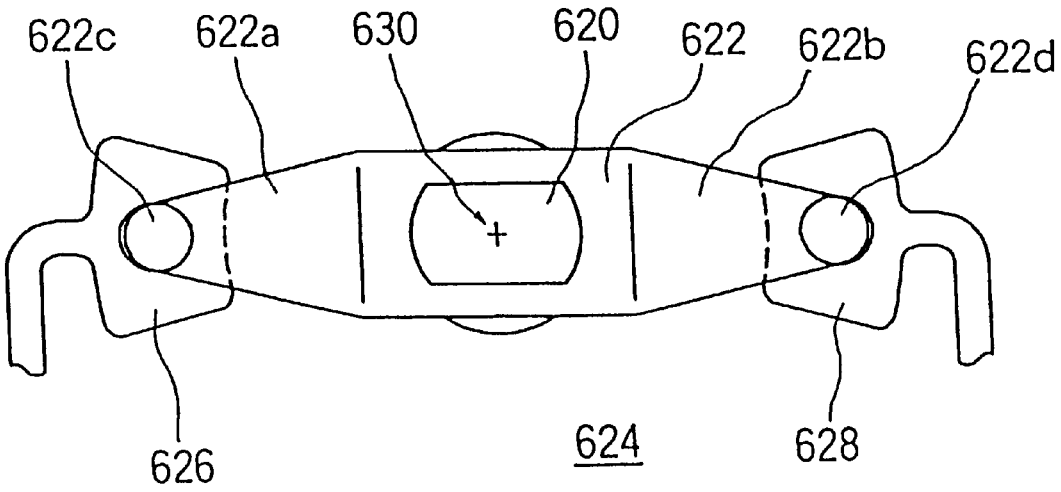
[FIG. 30] A partial plan view showing a structure of a contact portion of the embodiment of the calendar electronic timepiece of the present invention.
Figure 31:
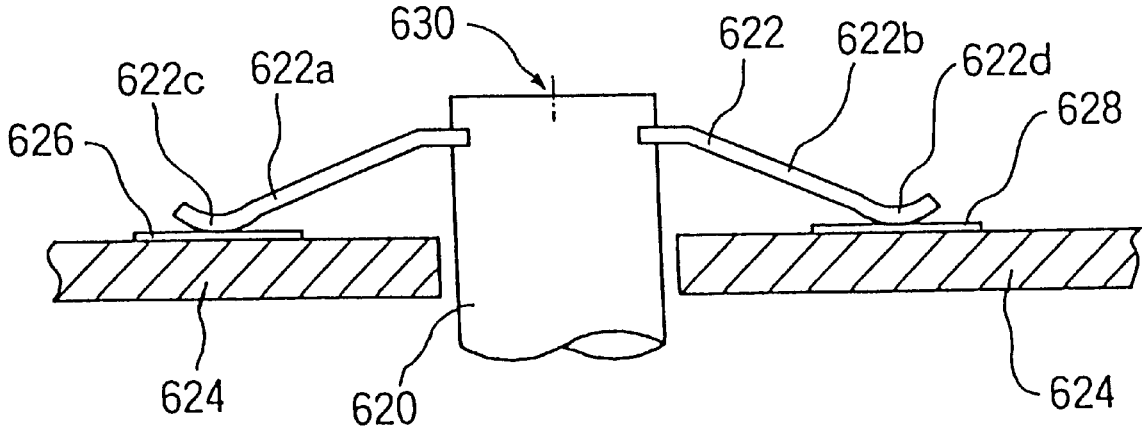
[FIG. 31] A partial sectional view showing the structure of the contact portion of the embodiment of the calendar electronic timepiece of the present invention.

Referring to FIG. 30 and FIG. 31, a transmitting wheel 620 is rotatably assembled in the electronic timepiece. The transmitting wheel is a part included in a train such as the wheel train or calendar wheel train for the calendar electronic timepiece. The transmitting wheel 620, in the calendar electronic timepiece 500 of the present invention, corresponds to the 24-hour wheel 550 and the date driving wheel 106.

A contact point spring 622 is fixed on the transmitting wheel 620. The contact point spring 622 is structured to have an electric conductivity. For example, the contact point spring 622 may be formed of a metal such as a stainless steel, or having a gold plating on a surface thereof.

Two contact point spring terminals 622*a* and 622*b* are provided in the contact point spring 622. A terminal contact portion 622*c* is provided at a tip of the contact point spring terminal 622*a*, while a terminal contact portion 622*d* is provided at a tip of the contact point spring terminal 622*a*.

A circuit substrate 624 is assembled in the calendar electronic timepiece, and has an A pattern 626 and a B pattern 628 provided on a surface of the circuit substrate 624. The A pattern 626 and the B pattern 628 are connected to the control circuit (not shown). When the A pattern and the B pattern are placed in conduction, a rotational position detecting signal is inputted to the control circuit (not shown).

The contact point spring 622 extends almost in a straight line form through a rotational center 630 of the transmitting wheel 620. The A pattern A and the B pattern 628 are arranged at almost 180 degrees relative to the rotational center 630 of the transmitting wheel 620. Consequently, when the transmitting wheel 620 rotates, a state occurs that the terminal contact portion 622*c* is contacted with the A pattern 626 and the terminal contact portion 622*d* is contacted with the B pattern 628. At this time, a position detecting signal is inputted to a control circuit (not shown). When the transmitting wheel 620 further rotates, the terminal contact portion 622*c* becomes out of contact from the A pattern 626 and the terminal contact portion 622*d* out of the contact from the B pattern 628. At this time, no rotational position detecting signal is generated.

Further, when the transmitting wheel 620 rotates, the terminal contact portion 622*c* becomes contact with the B pattern 628 and the terminal contact portion 622*d* contact with the A pattern 626. At this time, a rotational position detecting signal is again inputted to the control circuit (not shown). When the transmitting wheel 620 further rotates, the terminal contact portion 622*c* is detached from the B pattern 628 and the terminal contact portion 622*d* is detached from the A pattern 626. At this time, no rotational position detecting signal is generated. The contact portions similarly operate regardless whether the transmitting wheel 620 rotates in a clockwise direction or rotates in a counterclockwise direction.

With this structure, when the transmitting wheel 620 makes one rotation, the rotational direction detecting signal is twice inputted to the control circuit (not shown). Consequently, where the transmitting wheel is structured to perform one rotation per 24 hours, the rotational position detecting signal is inputted to the control circuit (not shown) every 12 hours. Where there is a necessity of counting by 24 hours as in a case of changing date indication, a provision is made such that a counting circuit for counting the number of generations of the rotational position detecting signals is provided in the control circuit so that a signal for changing the date indication is outputted when the rotational position detecting signal is twice inputted.

Then, explanations will be made on the operation of the fifth embodiment of the calendar electronic timepiece 500.

When the control circuit outputs a count result of 0 o'clock a.m., the 24-hour contact point spring 552 contacts with the first pattern (not shown) of the circuit block 534. At this time, the 24-hour contact point spring outputs a detection signal by which the circuit block 534 causes the ultrasonic rotor 102 of the ultrasonic motor 132 to rotate. The rotation of the ultrasonic rotor 102 rotates the date driving wheel 106 to rotate the date dial 110 through the date finger 108. This makes possible change of date indication.

When the date dial is rotated by 360°/31, i.e. a 1/31 rotation, the date driving wheel contact point spring 556 comes into contact with the second pattern (not shown) of the circuit block 534. At this time, the date driving wheel contact point spring 556 outputs a detection signal by which the circuit block 534 stops rotation of the ultrasonic rotor 102 of the ultrasonic motor 132.

Then, the 24-hour contact point spring 552 goes out of contact with the first pattern of the circuit block 534, and the date driving wheel contact point spring 556 becomes out of contact with the second pattern of the circuit block 534. This state is maintained to a state of the next day that the control circuit again outputs a count result of 0 o'clock a.m.

Incidentally, the time of starting and ending the date drive is not necessarily accurately at 0 o'clock a.m. It may be a time before 0 o'clock a.m. or after 0 o'clock a.m.

With this structure, it is possible to accurately start a date drive at a same time every day with the date dial accurately kept. As a result, there is almost no fear that the calendar electronic timepiece of the present invention has no positional deviation of a date character of the date dial.

Therefore, the calendar electronic timepiece of the present invention has preferably the following structures.

[1] In a calendar electronic timepiece, having a function to indicate information about calendar, the calendar electronic timepiece being characterized by comprising:

a time signal generating circuit for counting on information about time to generate a time signal;

a time indication motor driving circuit for outputting a time indicating motor drive signal to rotate a time indicating motor based on the time signal outputted by the time signal generating circuit;

the time indicating motor that rotates based on the time indicating signal outputted by the time indicating motor drive circuit;

a time indicating wheel train that rotates based on rotation of the time indicating motor;

a time information indicating member for indicating time information based on rotation of the time indicating wheel train;

a date signal generating circuit for counting on information about a date to generate a date signal;

a date indicating motor drive circuit for outputting a date signal to rotate the date indicating motor based on a date signal outputted by the date signal generating circuit;

a date indicating motor that rotates based on the date indicating signal outputted by the date indicating motor drive circuit;

a date indicating wheel train that rotates based on rotation of the date indicating motor;

a date information indicating member for indicating date information based on rotation of the date indicating wheel train;

a date drive start detecting member for detecting a date drive start time point based on rotation of the time indicating wheel train;

a date drive end detecting member for detecting a date drive end time point based on rotation of the time indicating wheel train;

a date drive control circuit for controlling on operation of the date indicating drive circuit, which outputs a date indicating motor drive signal, by inputting a signal about a date drive start outputted by the date drive start detecting member and inputting a signal about a date drive end outputted by the date drive end detecting member.

[2] A calendar electronic timepiece as recited in the above [1] characterized in that the date indicating motor is structured by a ultrasonic motor.

[3] A calendar electronic timepiece as recited in the above [1] or [2] characterized in that the date drive start detecting member is provided on a 24-hour wheel rotated by rotation of hour wheel, the date drive end detecting member being provided on a date driving wheel rotated by rotation of the date indicating motor.

Figure 14:
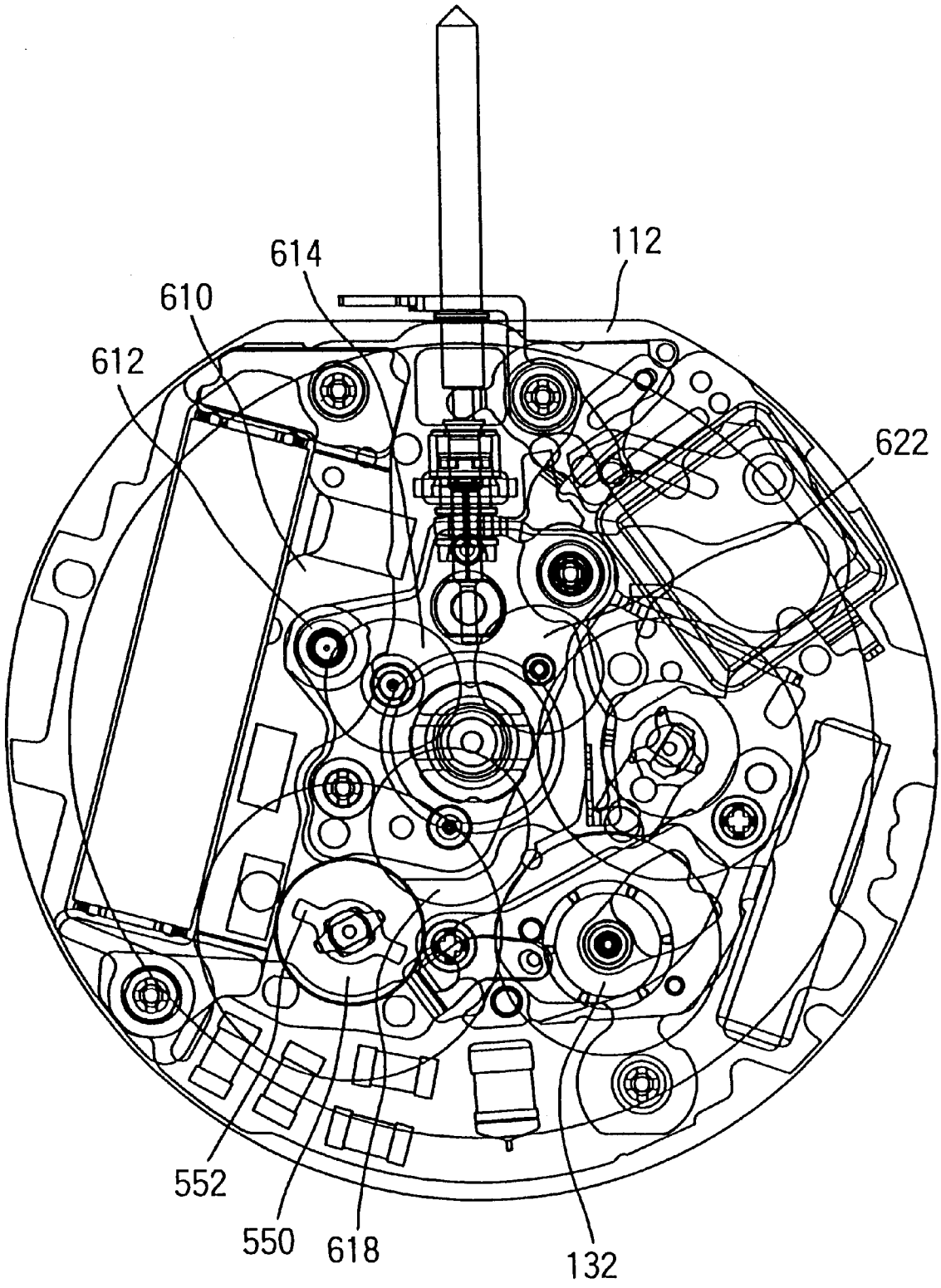
[FIG. 14] A schematic plan view (projection view) showing a main surface portion of the first embodiment of the calendar electronic timepiece of the present invention.

(6) Overall structure of the first embodiment of the calendar electronic timepiece FIG. 14 shows a main surface side portion of a movement (mechanical members) of the first embodiment of the calendar electronic timepiece of the present invention. Here, the "main surface side portion" refers to a portion opposite to the side having the dial 570 with respect to the main plate.

Figure 15:
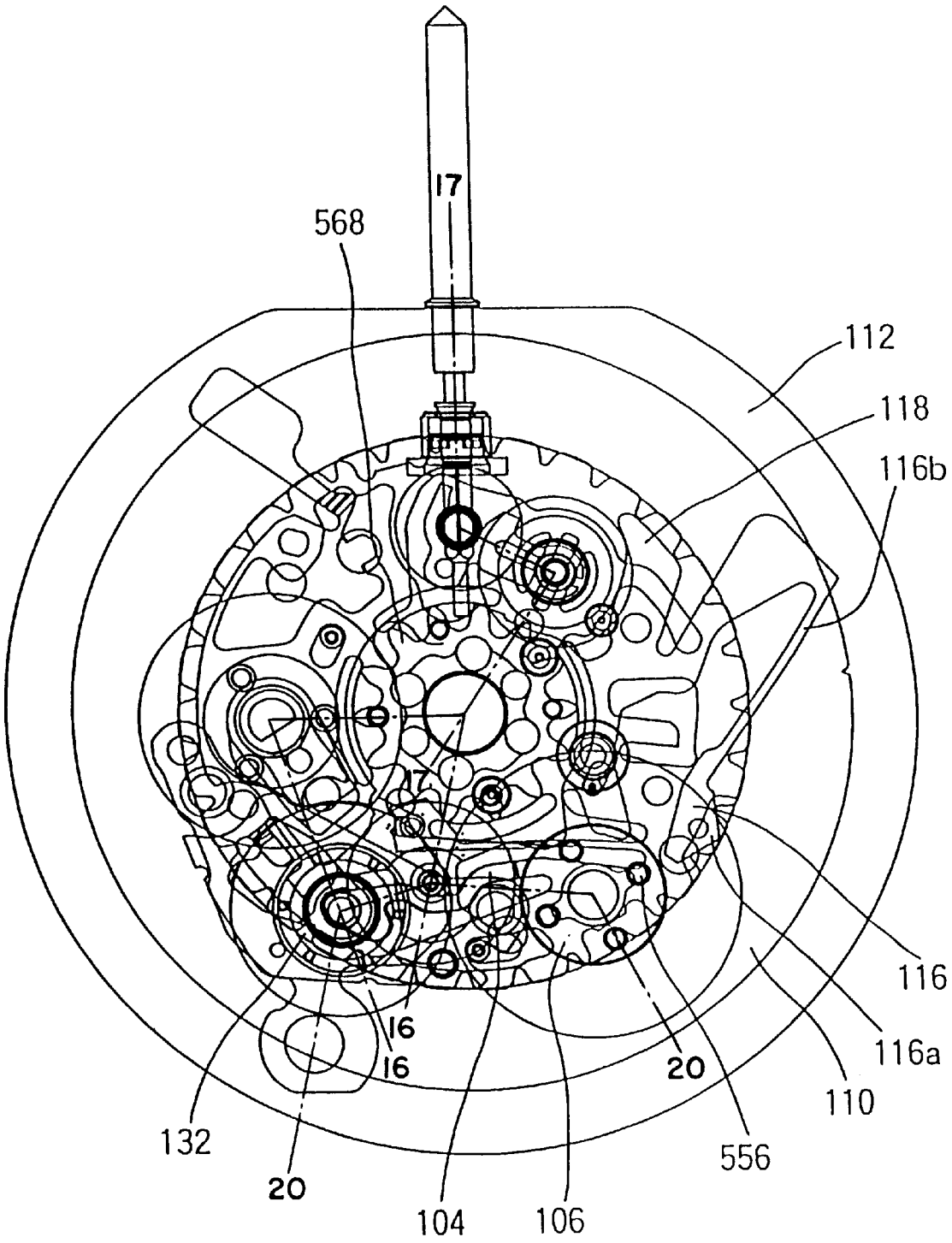
[FIG. 15] A schematic plan view (projection view) showing a back surface portion of the first embodiment of the calendar electronic timepiece of the present invention.
Figure 16:
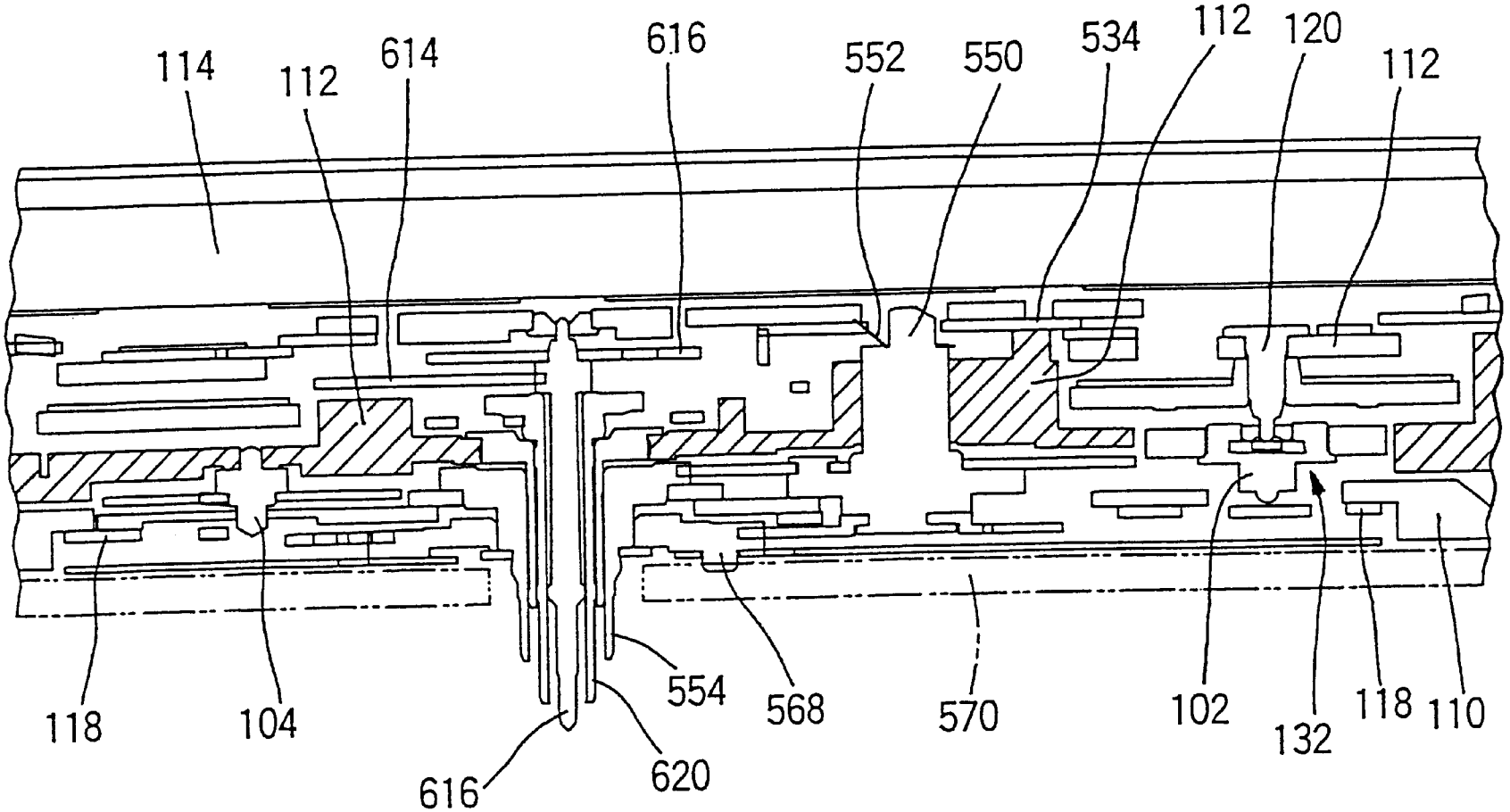
[FIG. 16] A schematic partial sectional view showing the first embodiment of the calendar electronic timepiece of the present invention.
Figure 17:
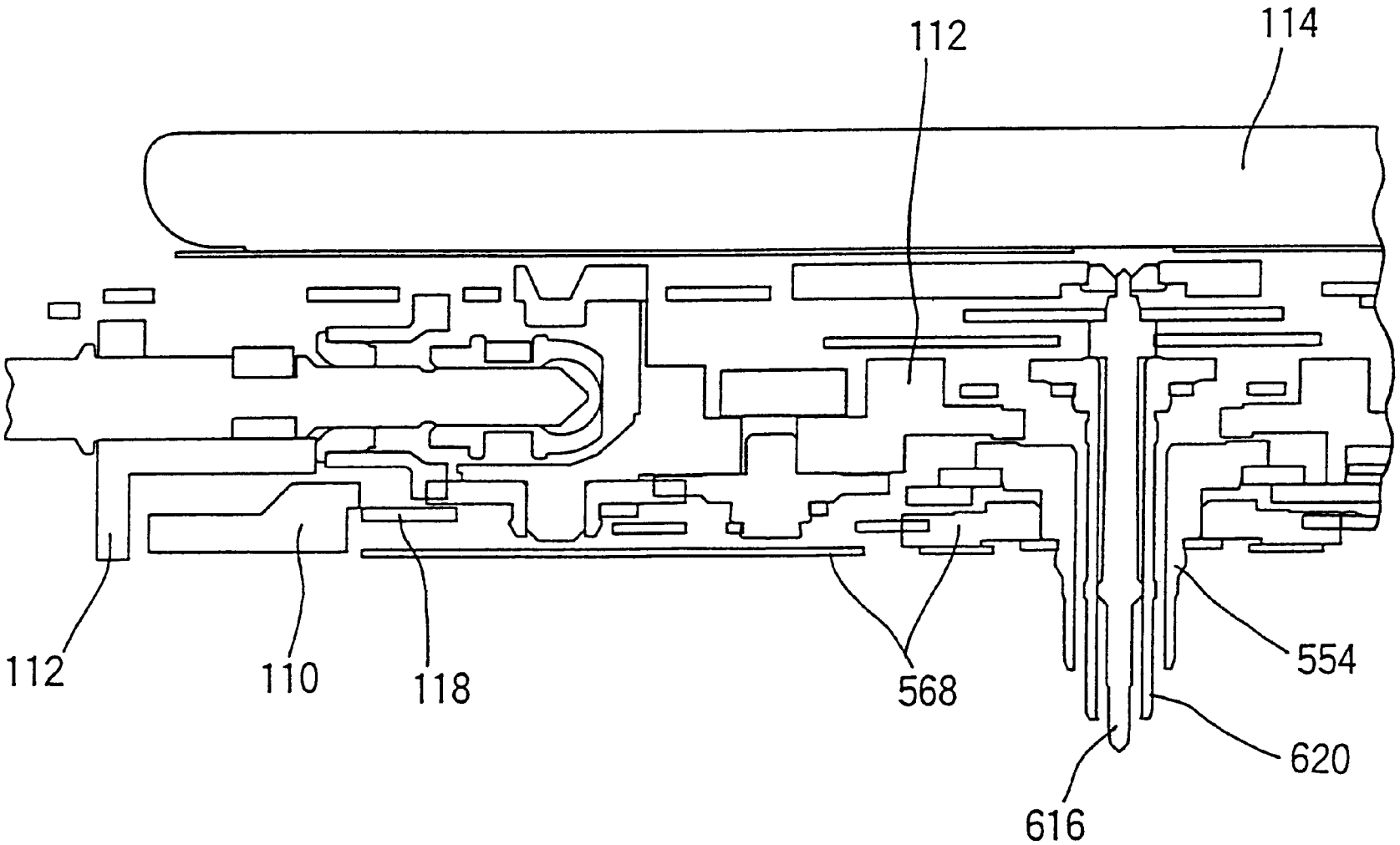
[FIG. 17] A schematic partial sectional view showing the first embodiment of the calendar electronic timepiece of the present invention.
Figure 18:
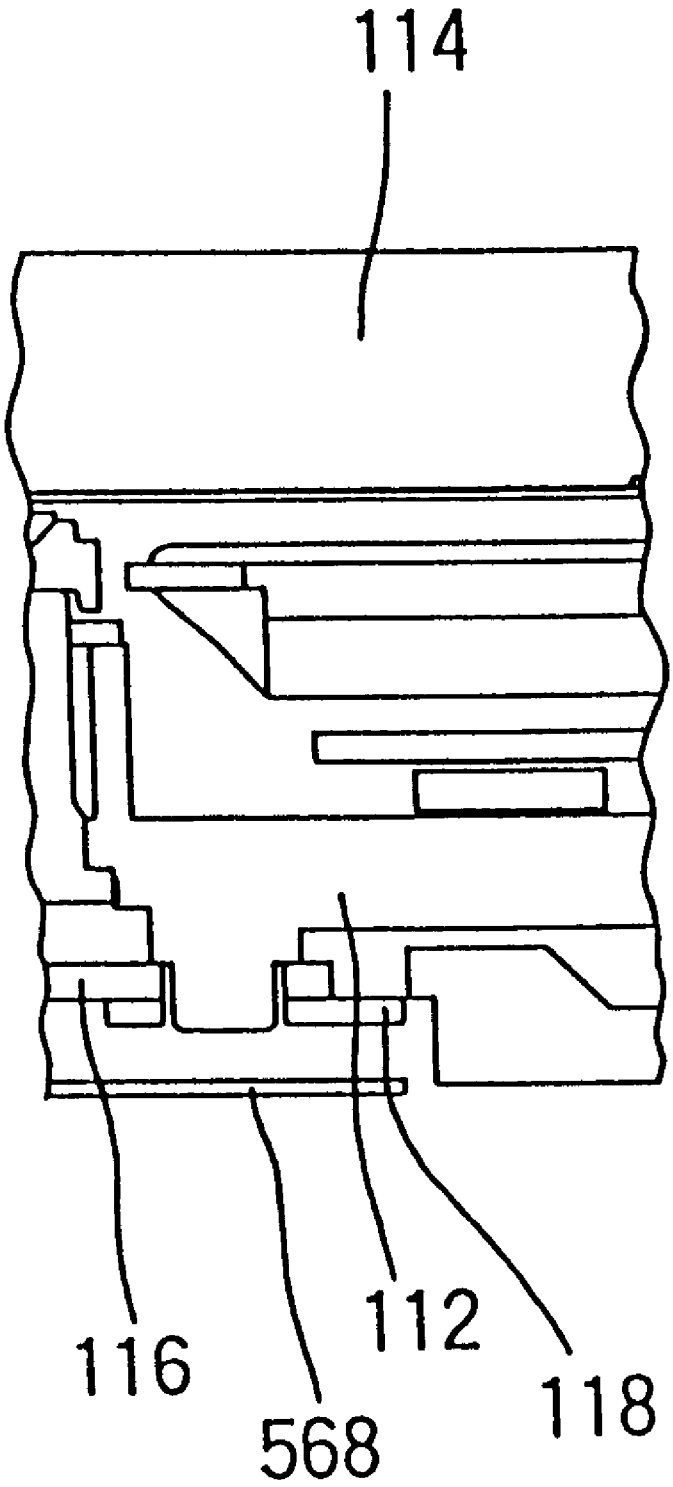
[FIG. 18] A schematic partial sectional view showing the first embodiment of the calendar electronic timepiece of the present invention.
Figure 19:
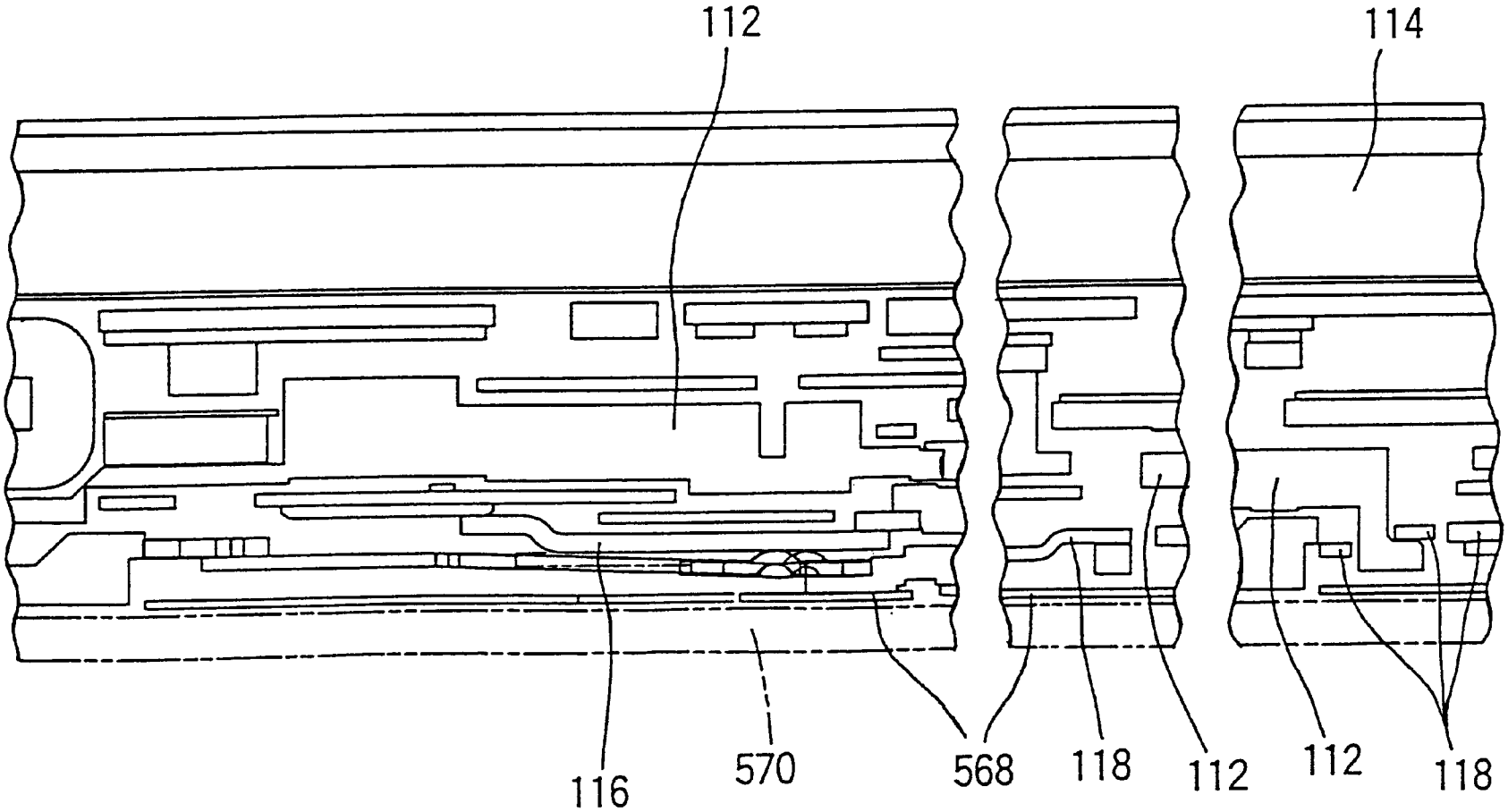
[FIG. 19] A schematic partial sectional view showing the first embodiment of the calendar electronic timepiece of the present invention.
Figure 20:
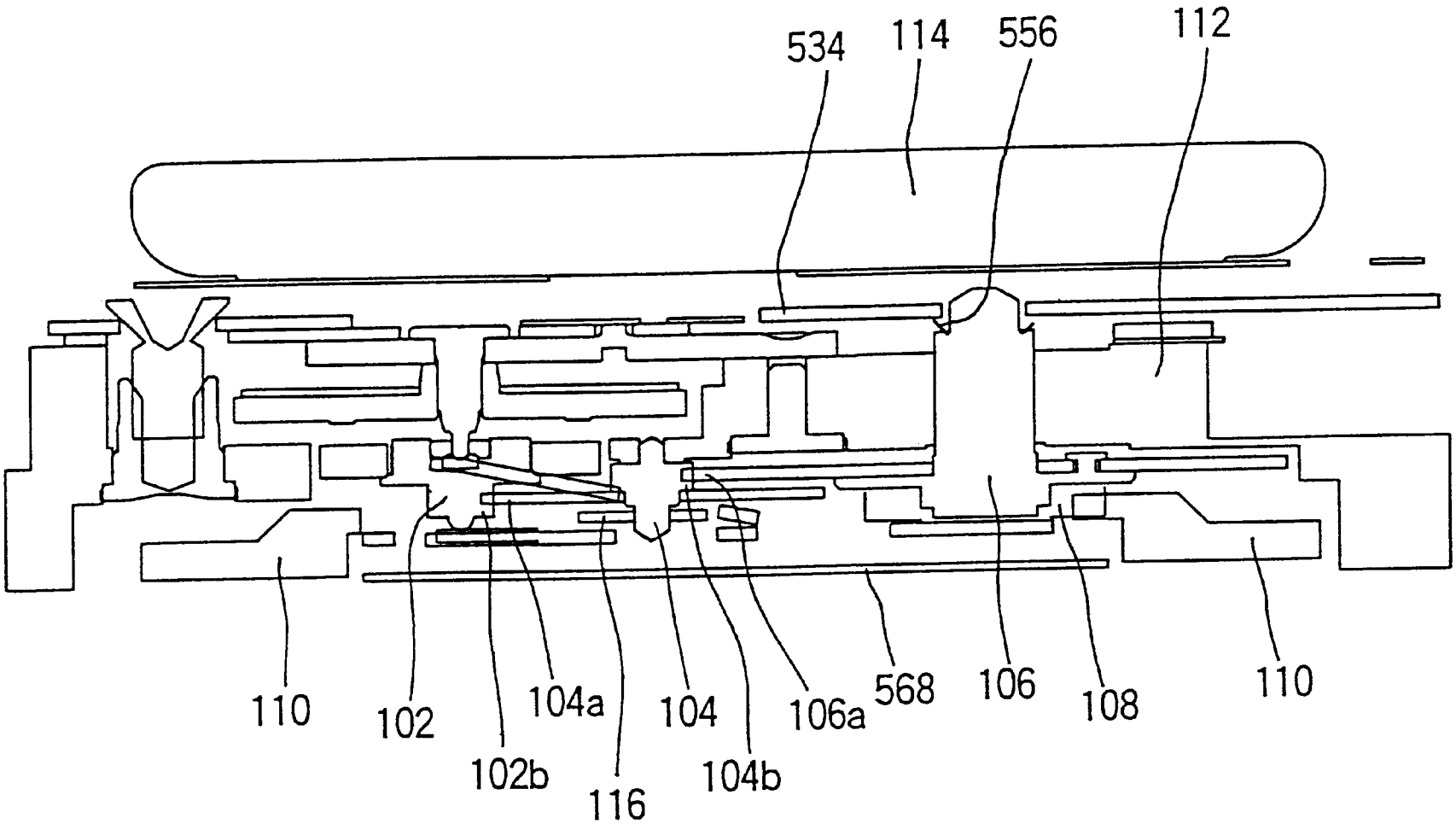
[FIG. 20] A schematic partial sectional view showing the first embodiment of the calendar electronic timepiece of the present invention.
Figure 21:
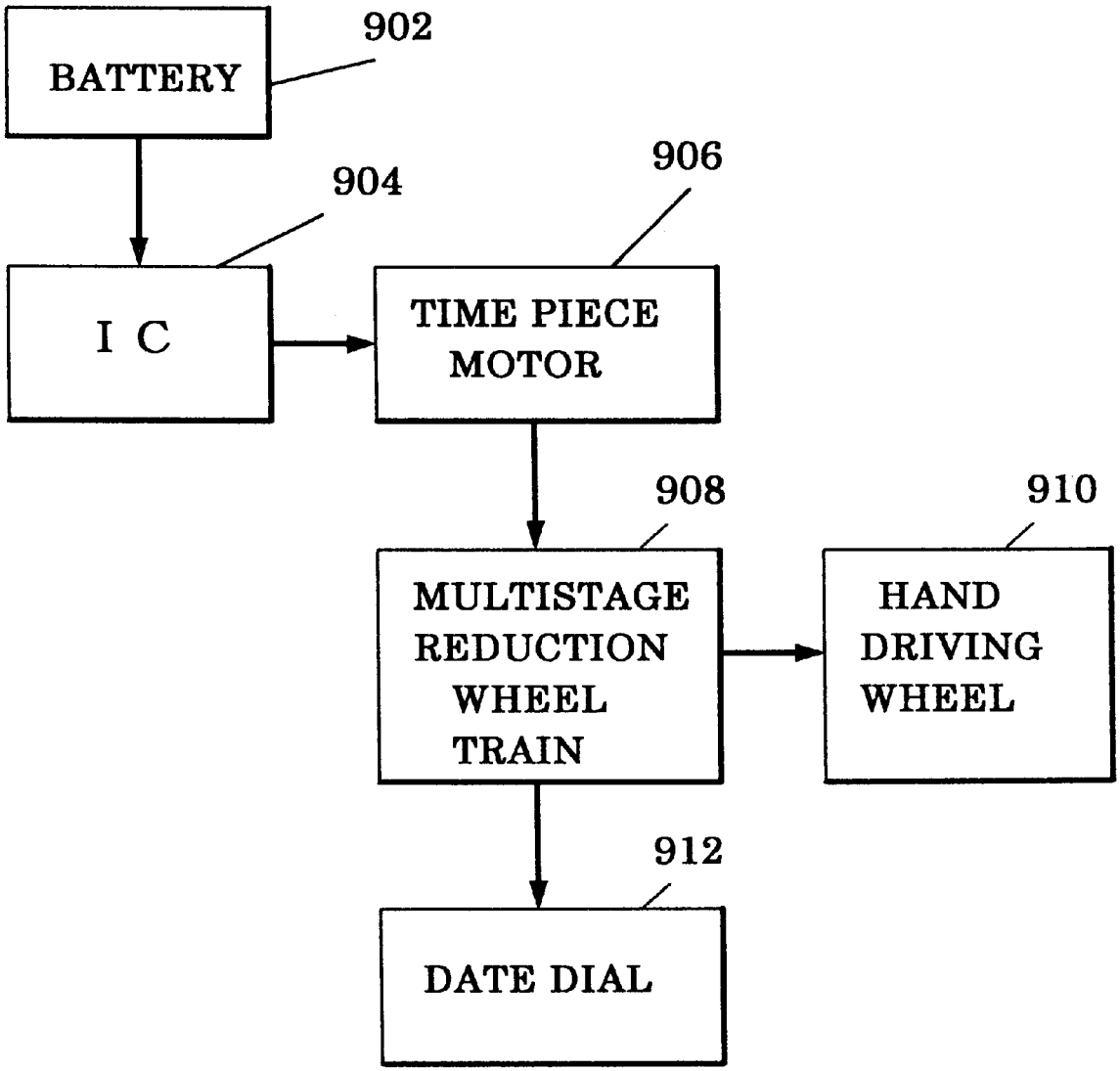
FIG. 21 PRIOR ART
[FIG. 21] A schematic block diagram showing a conventional calendar electronic timepiece.
Figure 22:
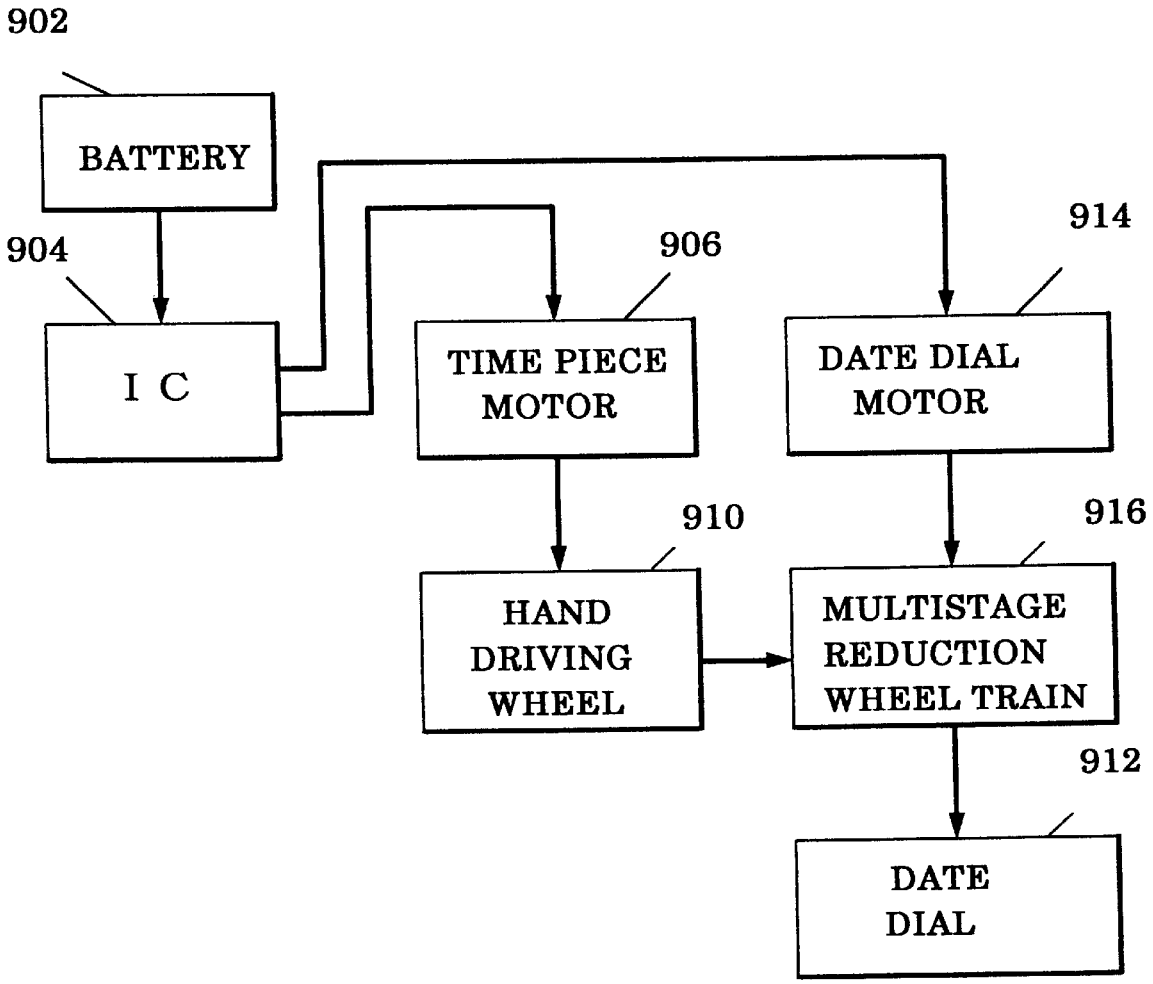
FIG. 22 PRIOR ART
[FIG. 22] A schematic block diagram showing another structure of a conventional calendar electronic timepiece.
Figure 23:
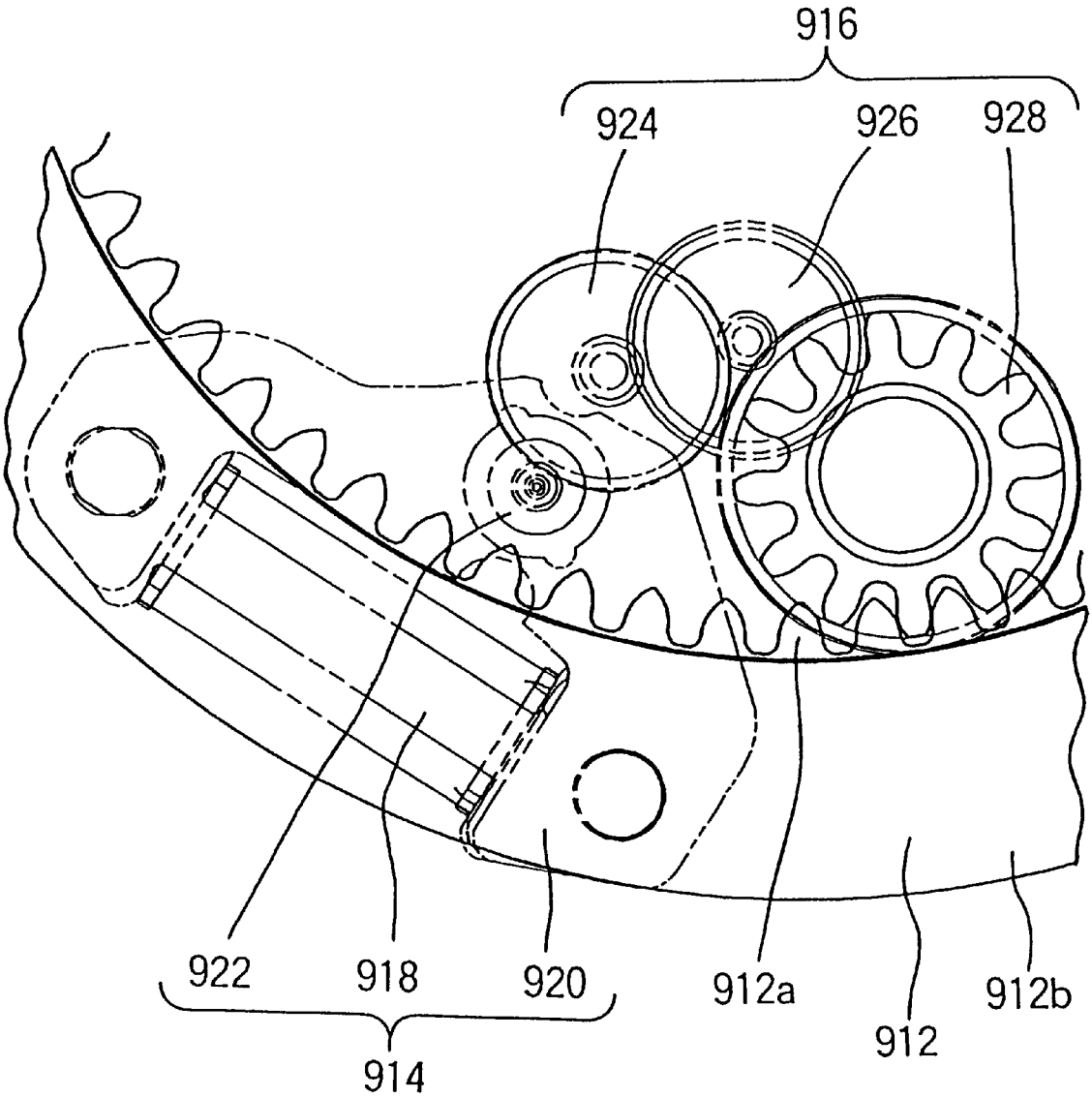
FIG. 23 PRIOR ART
[FIG. 23] A schematic plan view showing another structure of a conventional calendar electronic timepiece.
Figure 24:
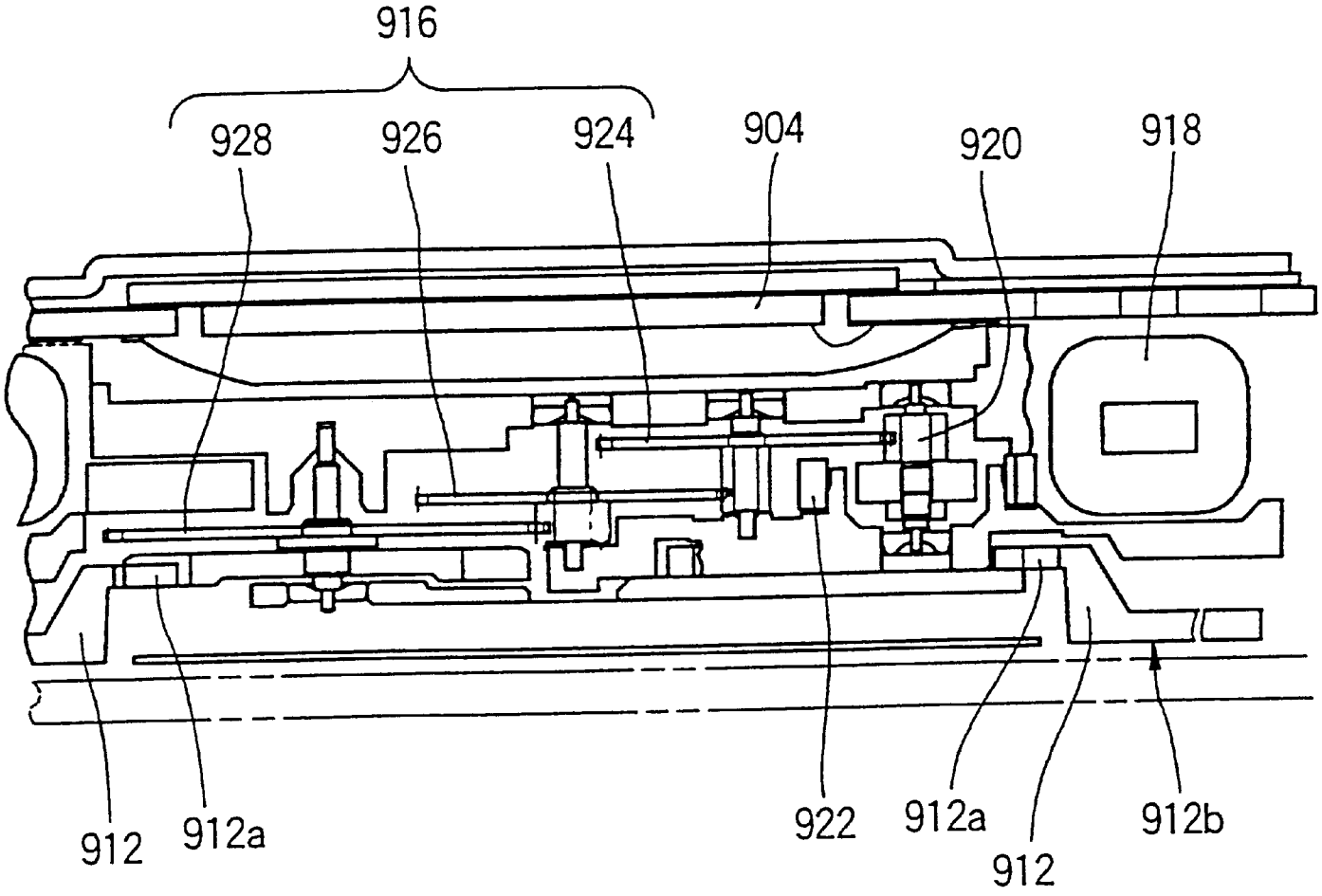
FIG. 24 PRIOR ART
[FIG. 24] A schematic sectional view showing another structure of a conventional calendar electronic timepiece.
Figure 25:
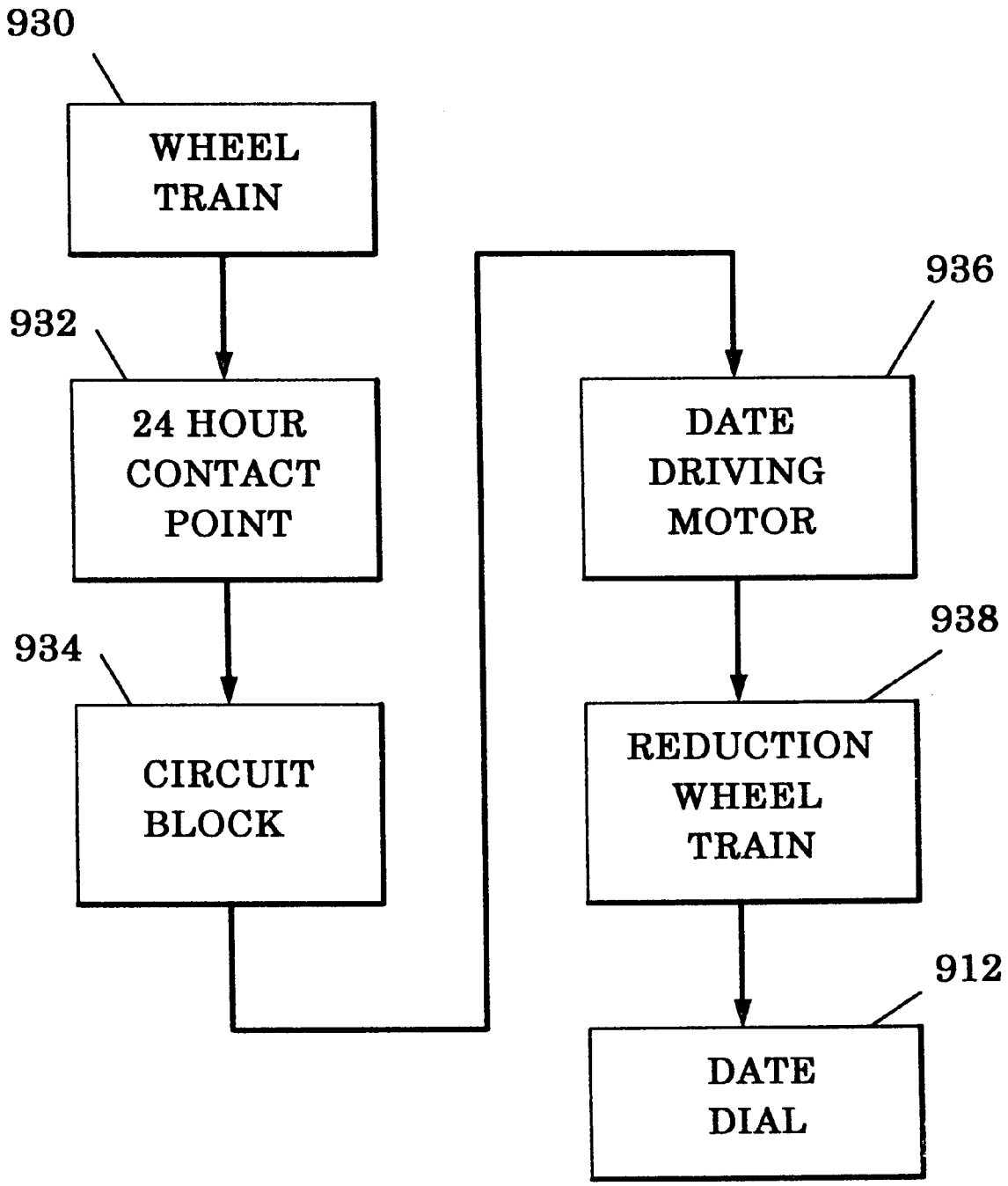
FIG. 25 PRIOR ART
[FIG. 25] A schematic block diagram showing another structure of a conventional calendar electronic timepiece.
Figure 26:
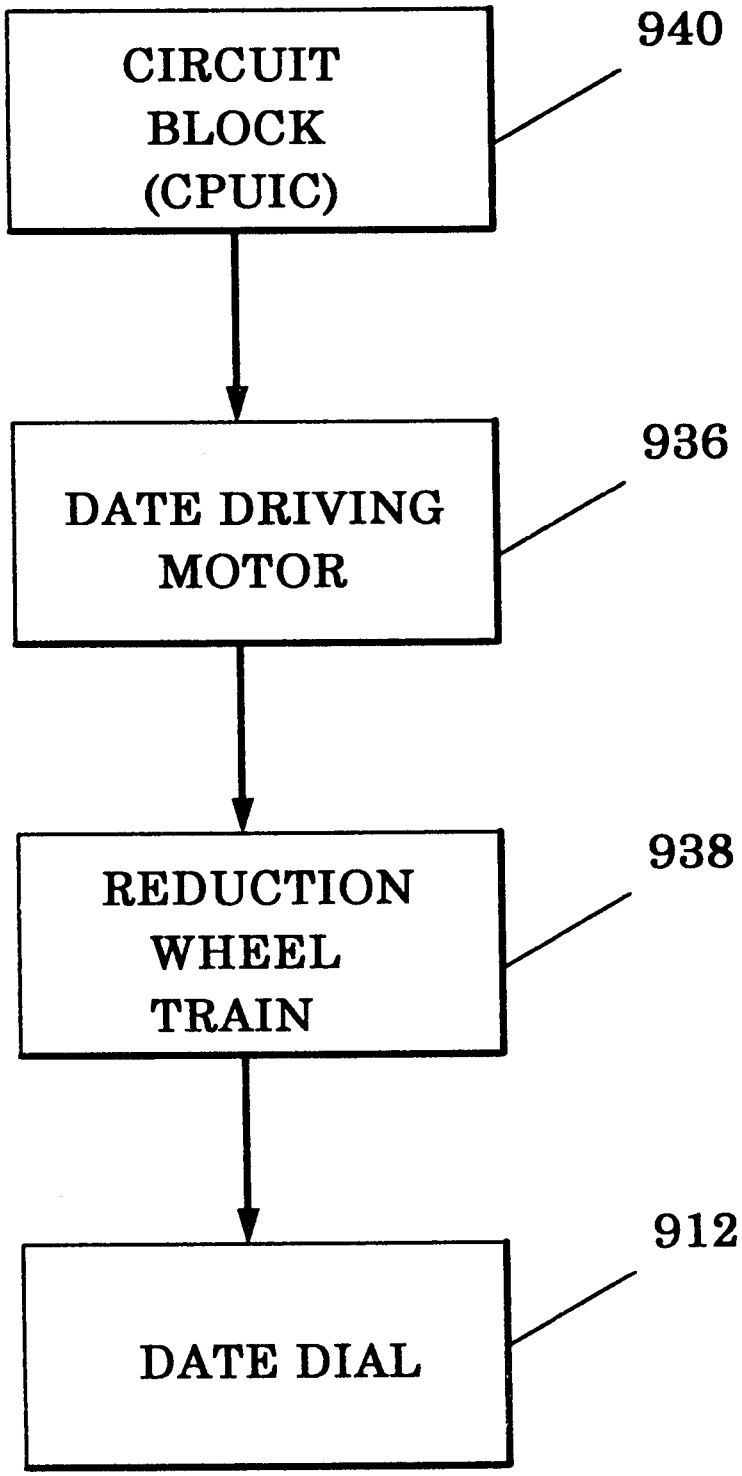
FIG. 26 PRIOR ART
[FIG. 26] A schematic block diagram showing another structure of a conventional calendar electronic timepiece.

FIG. 15 shows a back surface side portion of the movement (mechanical members) of the first embodiment of the calendar electronic timepiece of the present invention. Here, the "back surface side portion" refers to a portion on the side having the dial 570 with respect to the main plate. That is, the date dial is assembled on the "back surface side".

A calendar electronic timepiece shown in FIG. 14 to FIG. 20 has also a contact point spring as possessed by the fifth embodiment of the present invention.

Referring to FIG. 14 through FIG. 20, the calendar electronic timepiece of the present invention has a main plate 112. A step motor 610 has a rotor 612 in mesh with a fifth wheel 614, and the fifth wheel 614 is in mesh with a fourth wheel 616. The rotation of the fourth wheel 616 rotates, through a third wheel 618, a minute wheel 620, which further rotates, through a date back wheel 622, an hour wheel 554.

A 24-hour wheel 550 has a 24-hour contact point spring 552. The 24-hour contact point spring 552 is arranged contactable with a first pattern (not shown) of a circuit block 534. The 24-hour wheel 550 is in mesh with the hour wheel 554 and rotated by one rotation per day. The hour wheel rotates by one turn per 12 hours so as to indicate an "hour" by an hour pointer (not shown) mounted on the hour wheel 554.

An ultrasonic motor 132 has an ultrasonic rotor axle 120 fixed on the main late 112 so that an ultrasonic rotor 102 is rotatably assembled on the ultrasonic rotor axle 120.

The ultrasonic rotor 102 has an ultrasonic rotor kana 102*b* in mesh with an intermediate date driving gear 104*a*. The intermediate date driving wheel 104 has an intermediate date driving kana 104*b* in mesh with a date driving gear 106*a* of the date driving wheel 106.

A date finger 108 is provided on the date driving wheel 106. A date dial 110, that is simultaneously rotated by the rotation of the date driving wheel 106, is rotatably assembled on the main plate 112. A battery 114 is assembled on an opposite side to the side mounted with the date dial 110 with respect to the main plate 112.

A date jumper 116 is integrally formed with a date dial holder 118. The date jumper 116 has a rectifying portion 116*a* to rectify a date dial tooth 110*a*. The date jumper 116 has a date jumper spring portion 116*b*.

That is, the date driving wheel 106 has a date driving wheel contact point spring 556. The date driving wheel contact point spring 556 is arranged contactable with a second pattern (not shown) of the circuit block 534.

Figure 32:
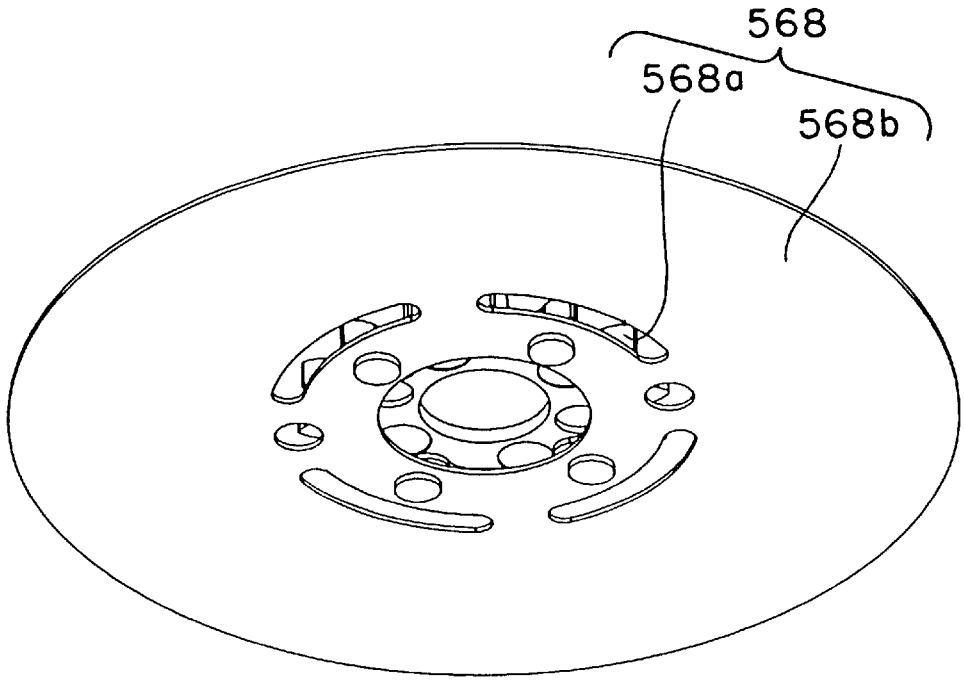
FIG. 32 is a front perspective view of the day indicator.
Figure 33:
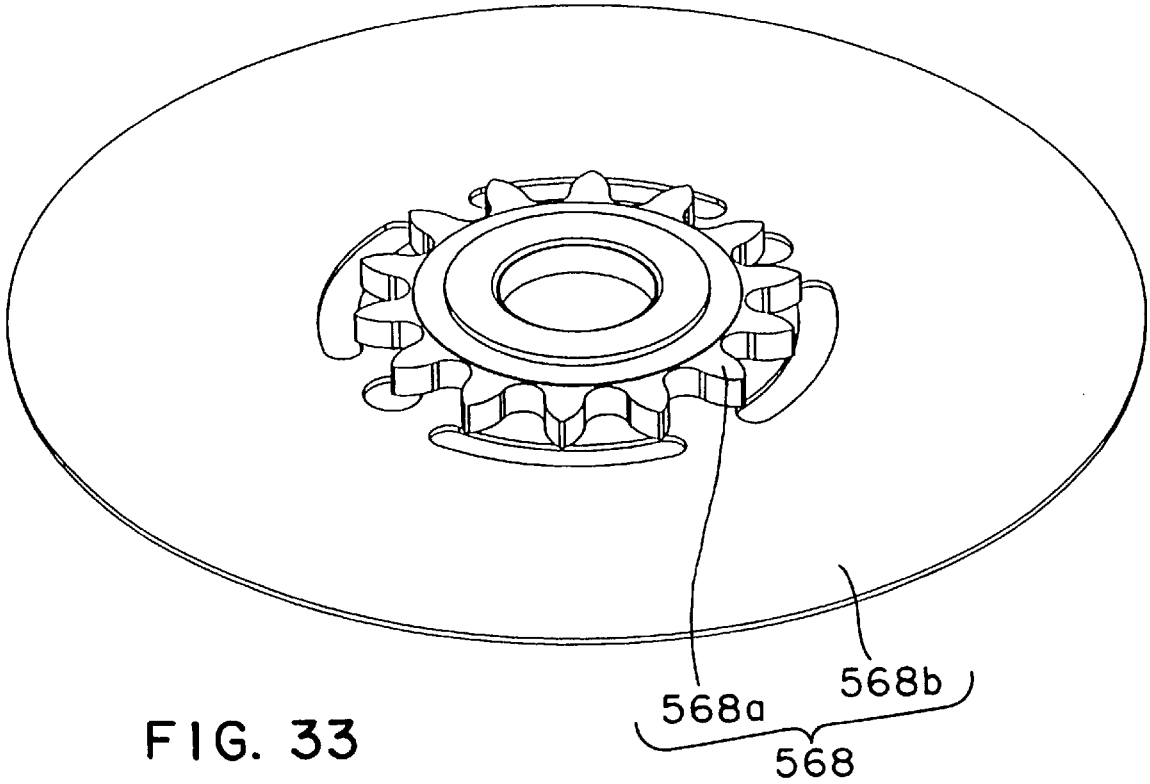
FIG. 33 is a rear perspective view of the day indicator.

In the embodiments of the calendar electronic timepiece of the present invention shown in FIG. 14 to FIG. 20, a day indicator 568 is provided to indicate a day of the week. The day indicator 568 is shown in more detail in FIGS. 32 and 33 and comprises a day star 568*a* and a day dial disk 568*b*. FIG. 32 is a front perspective view of the day indicator 568, and FIG. 33 is a rear perspective view thereof.

Incidentally, the indication of a day of the week may be structured to perform by a day indicator rotated by rotation of the ultrasonic motor, as stated before.

The present invention is structured, in a calendar electronic timepiece, to have the ultrasonic motor to rotate the date dial as stated above, and has the following effects.

(1) Date is accurately indicated by the date dial.

(2) The date dial is slowed in rotational speed by the use of the ultrasonic motor, shortening the calendar drive time.

(3) The use of the ultrasonic motor increases the drive torque to the date dial.

(4) Providing a small-and-thin calendar electronic timepiece.

(5) The use of the date jumper can accurate position the date dial in position.

Also, the present invention has the following effects, because it has, in a calendar electronic timepiece, a date drive start detecting member for detecting a date drive start time point based on rotation of the time indicating wheel train, and a date drive end detecting member for detecting a date drive end time point based on rotation of the time indicating wheel train.

(6) Date drive can be accurately started at a same time every day.

(7) The date dial can be accurately held in position. Therefore, there is almost no fear of positional deviation of a date character of the date dial.

What is claimed is:

1. A calendar electronic timepiece for indicating calendar information, the calendar electronic timepiece comprising:

a time signal generating circuit for counting date information to generate a date signal;

an ultrasonic motor driving circuit for outputting an ultrasonic motor driving signal in accordance with the date signal generated by the time signal generating circuit; and an ultrasonic motor having an ultrasonic stators a piezoelectric element connected to the ultrasonic stator and being driven to undergo expansion and contraction, and an ultrasonic rotor constituting a date dial connected to the ultrasonic stator to be frictionally driven by expansion and contraction of the piezoelectric element in accordance with the ultrasonic motor driving signal outputted by the ultrasonic motor driving circuit.

2. A calendar electronic timepiece according to claim 1; further comprising a date jumper connected to a tooth portion of the date dial for rectifying a rotational position of the date dial.

3. A calendar electronic timepiece comprising: signal generating means for generating a date signal; driving means for outputting a driving signal in accordance with the date signal generated by the signal generating means; and an ultrasonic motor comprised of a piezoelectric vibrator having an electrode pattern and being driven by the driving signal outputted from the driving means to undergo expansion and contraction movement, a vibrating member connected to the piezoelectric vibrator and vibrationally driven by expansion and contraction movement of the piezoelectric vibrator, and a date dial disposed on the vibrating member to be frictionally driven by expansion and contraction movement of the piezoelectric vibrator.

4. A calendar electronic timepiece according to claim 3; further comprising rectifying means for rectifying a moving position of the date dial.

5. A calendar electronic timepiece according to claim 4; wherein the rectifying means comprises a date jumper connected to a tooth portion of the date dial.

* * * * *